US008403237B2

(12) United States Patent
Ficyk et al.

(10) Patent No.: US 8,403,237 B2
(45) Date of Patent: Mar. 26, 2013

(54) ARTICULATED WATER NOZZLE SYSTEM

(76) Inventors: Zachary Ficyk, Concord (CA); John Harmen, Mississauga (CA)

( * ) Notice: Subject to any disclaimer, the term of this patent is extended or adjusted under 35 U.S.C. 154(b) by 509 days.

(21) Appl. No.: 12/720,061

(22) Filed: Mar. 9, 2010

(65) Prior Publication Data

US 2010/0237167 A1 Sep. 23, 2010

Related U.S. Application Data

(60) Provisional application No. 61/161,593, filed on Mar. 19, 2009.

(51) Int. Cl.
*B05B 17/08* (2006.01)

(52) U.S. Cl. ..... 239/17; 239/19; 239/247; 239/280.5; 239/225.1; 239/587.1

(58) Field of Classification Search ..... 239/17, 239/19, 229, 246, 247, 264, 280.5, 225.1, 239/587.1

See application file for complete search history.

(56) References Cited

U.S. PATENT DOCUMENTS

| | | | | |
|---|---|---|---|---|
| 2,729,295 | A | 2/1953 | Edwards | |
| 3,770,062 | A | 11/1973 | Riggs | |
| 3,776,173 | A | 12/1973 | Horwitz | |
| 3,907,204 | A | 9/1975 | Przystawik | |
| 3,957,207 | A | 5/1976 | Chronic | |
| 3,989,109 | A | 11/1976 | Gagliardo | |
| 4,002,293 | A | 1/1977 | Simmons | |
| 4,007,793 | A | 2/1977 | Hux et al. | |
| 4,506,738 | A | 3/1985 | Evans et al. | |
| 4,826,079 | A | 5/1989 | Przystawik | |
| 5,078,320 | A | 1/1992 | Fuller et al. | |
| 5,524,822 | A | 6/1996 | Simmons | |
| 5,551,898 | A | 9/1996 | Matsumoto | |
| 5,657,496 | A * | 8/1997 | Corb et al. | 4/541.6 |
| 5,918,809 | A | 7/1999 | Simmons | |
| 6,045,449 | A | 4/2000 | Aragona et al. | |
| 6,053,423 | A | 4/2000 | Jacobsen et al. | |
| 6,119,955 | A * | 9/2000 | Starr | 239/11 |
| 6,131,819 | A | 10/2000 | Fuller et al. | |
| 6,655,613 | B1 | 12/2003 | Brown | |
| 8,177,141 | B2 * | 5/2012 | Hagaman | 239/18 |

FOREIGN PATENT DOCUMENTS

| | | |
|---|---|---|
| CA | 2285728 | 4/2000 |
| EP | 0994295 A2 | 4/2000 |
| EP | 0994295 A3 | 4/2000 |
| JP | 2000162997 | 6/2000 |
| KR | 20000035003 | 6/2000 |
| SG | 79281 | 3/2001 |

* cited by examiner

*Primary Examiner* — Dinh Q Nguyen

(74) *Attorney, Agent, or Firm* — Bereskin and Parr LLP/S.E.N.C.R.L., s.r.l.

(57) ABSTRACT

The present invention relates to an articulated nozzle system comprising a nozzle cap for directing water exiting the nozzle cap, wherein the water exiting the nozzle cap has an average flow direction away from a nozzle cap base plane. The articulated nozzle system further comprises a nozzle cap driver for orienting the nozzle cap about a central pivot point to adjustably define the average flow direction, wherein the nozzle cap driver is linked to the nozzle cap. The nozzle cap driver can be moved along a plane, referred to as a driver support plane, by a drive module. Changing the location of nozzle cap driver along the driver support plane can change the orientation of the nozzle cap about the central pivot to adjust the average flow direction of the water exiting the nozzle cap.

21 Claims, 30 Drawing Sheets

Figure 1:
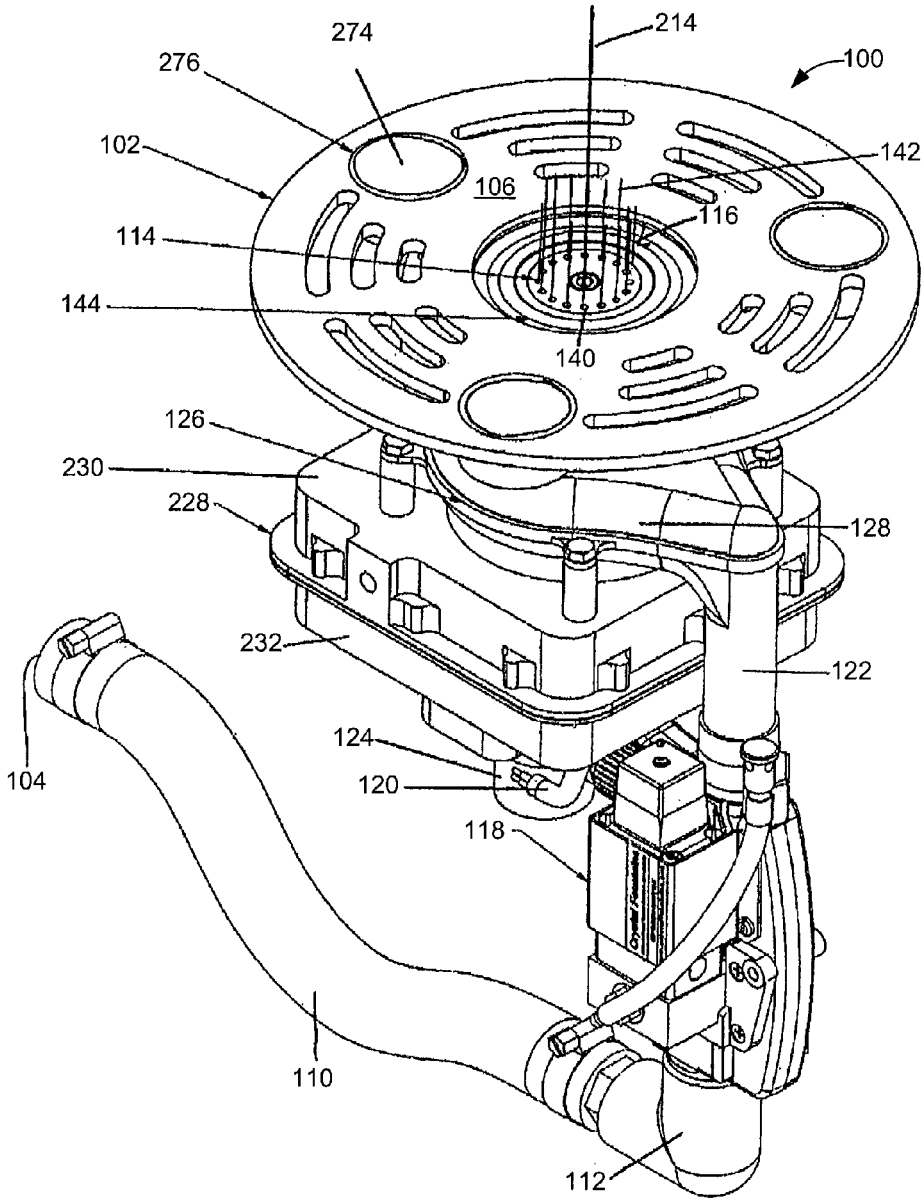

FIG. 4
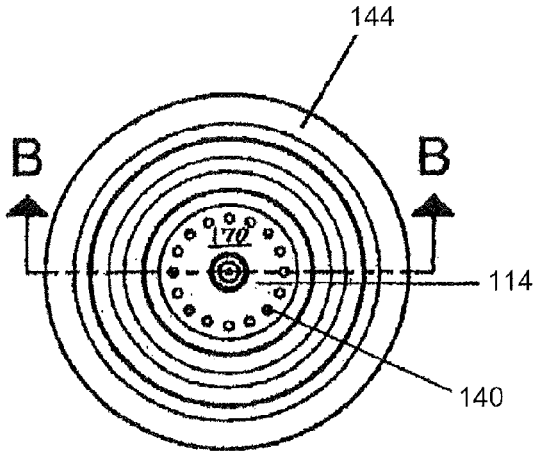
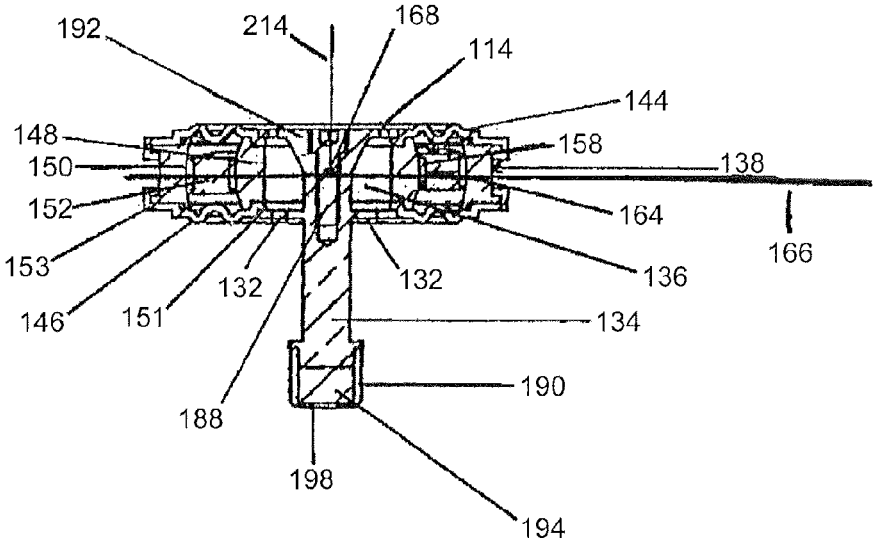
FIG. 5

ARTICULATED WATER NOZZLE SYSTEM

This is a non-provisional application of U.S. Application No. 61/161,593 filed Mar. 19, 2009. The contents of U.S. Application No. 61/161,593 are incorporated herein by reference.

FIELD

The present invention relates to an articulated water nozzle system.

INTRODUCTION

Systems and devices for moving a water stream exiting via a water nozzle are known. Examples of such devices include U.S. Pat. Nos. 6,131,819 and 6,053,423.

SUMMARY

In accordance with an aspect of an embodiment of the invention, there is provided an articulated nozzle system, comprising: a) a water inlet for receiving water from a water supply; b) a nozzle cap for receiving the water from the water supply via the water inlet, and for directing the water exiting the nozzle cap, the water exiting the nozzle cap having an average flow direction away from a nozzle cap base plane; c) a nozzle cap driver for orienting the nozzle cap about a central pivot point to adjustably define the average flow direction, the nozzle cap driver being linked to the nozzle cap; d) a driver support surface for supporting the nozzle cap driver in a driver support plane, wherein the driver support plane is defined by a central axis normal to the driver support plane, the intersection of the central axis and the driver support plane defining a driver plane center; e) a nozzle cap support for supporting the nozzle cap, wherein the nozzle cap support has a central pivot point and a fixed support portion, the fixed support portion being substantially stationary relative to the driver plane center; and f) a drive module for moving the nozzle cap driver along the driver support plane. Changing a radial displacement of the nozzle cap driver relative to the driver plane center is operable to change an elevation angle of the average flow direction relative to the nozzle cap base plane. The average flow direction lies in a trajectory plane that is orthogonal to the nozzle cap base plane, the trajectory plane being definable by Cartesian coordinates originating at the central pivot point. The trajectory plane has a first dimension parallel to the nozzle cap base plane and a second dimension orthogonal to the nozzle cap base plane. The average flow direction is resolvable to be defined by a trajectory plane base component that is parallel to the first dimension and a trajectory plane elevation component that is parallel to the second dimension. Changing the angular orientation of the nozzle cap driver about the driver plane center is operable to change an angular orientation of the trajectory plane base component. The drive module is linked to the nozzle cap driver, and the driver support surface is within the drive module. The nozzle cap is in fluid communication with the water inlet.

DRAWINGS

Figure 2:
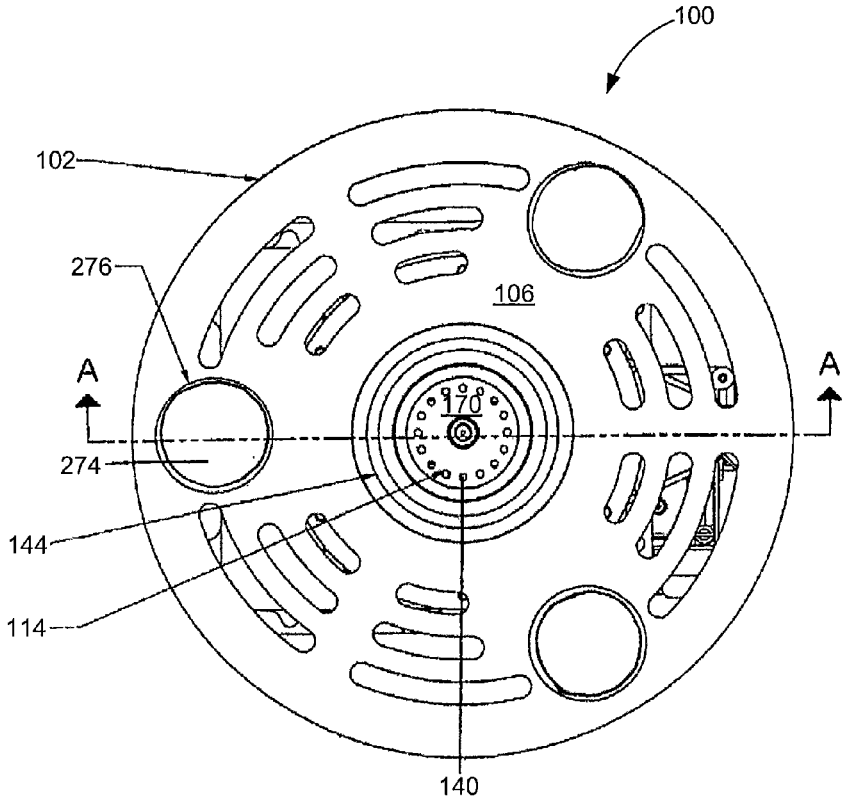
Figure 3:
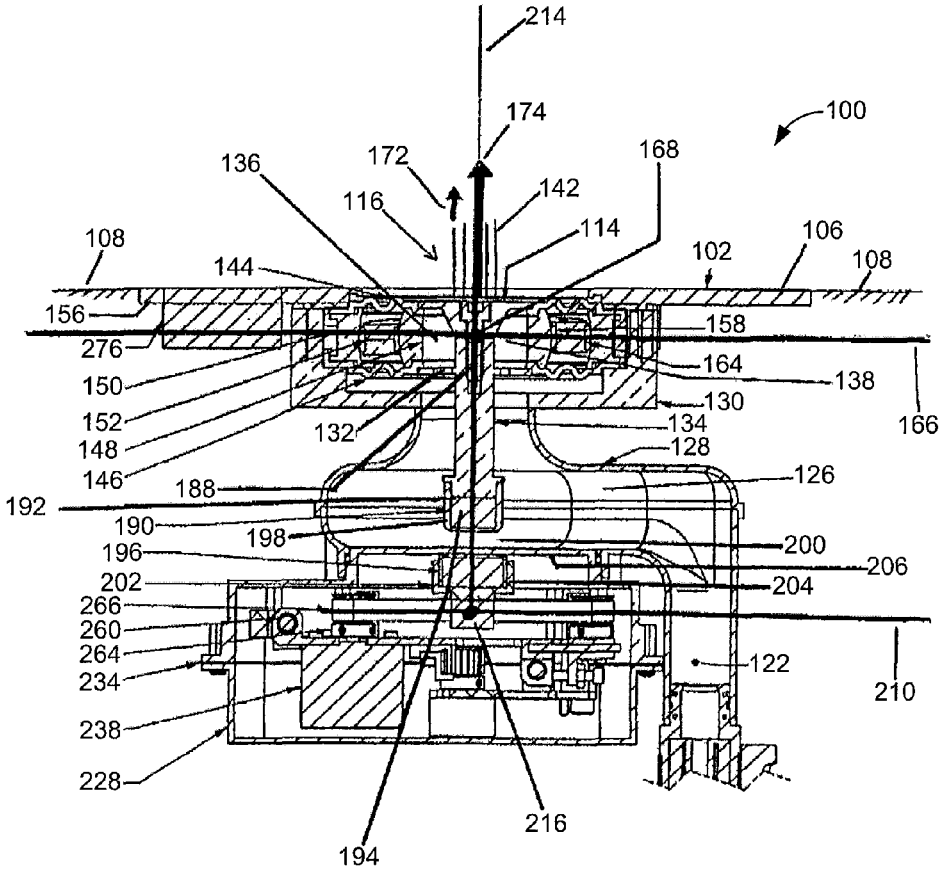
Figure 6:
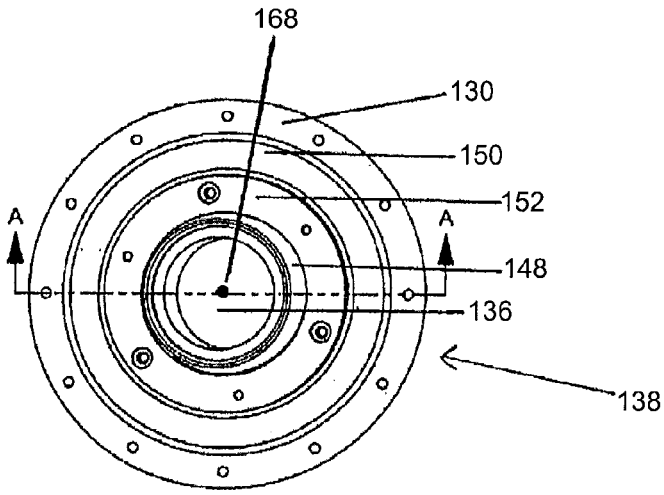
Figure 7:
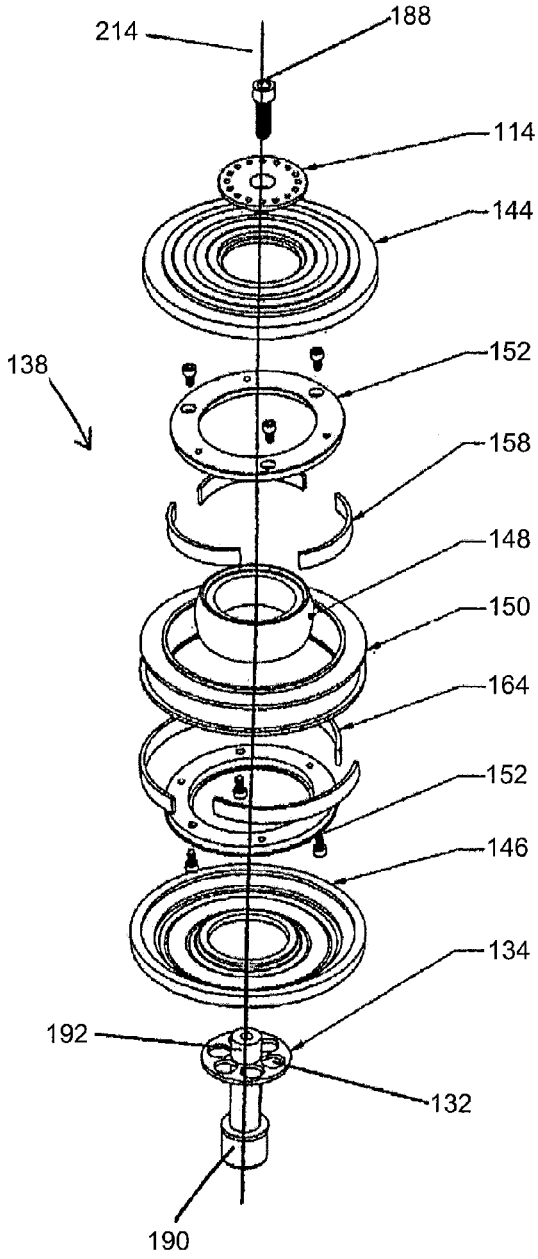
Figure 8:
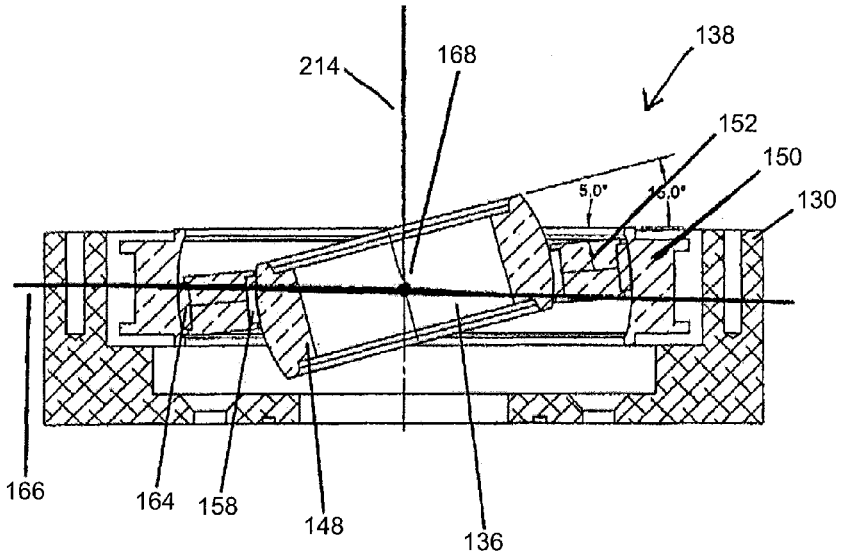
Figure 9:
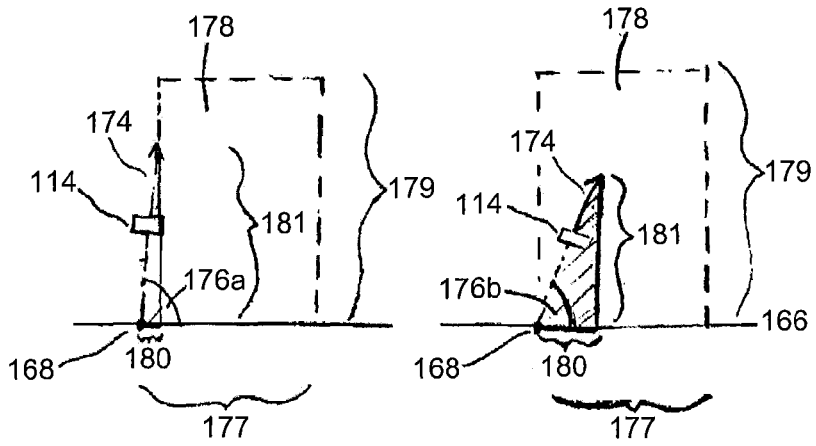
Figure 10:
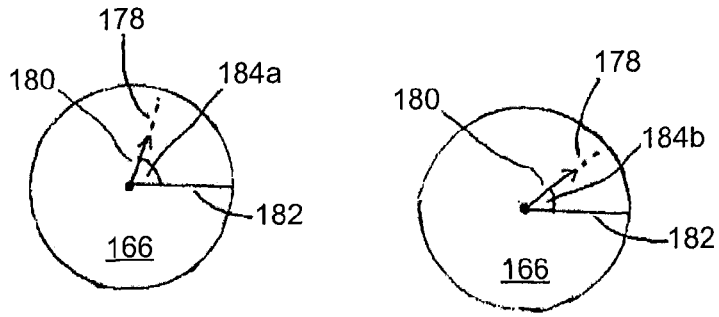
Figure 11A:
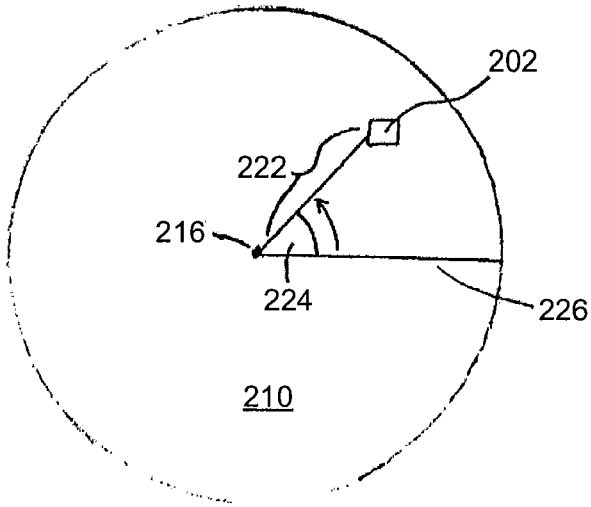
Figure 11B:
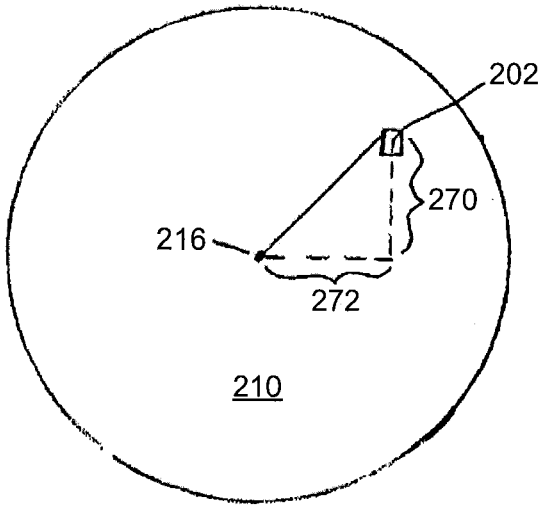
Figure 12:
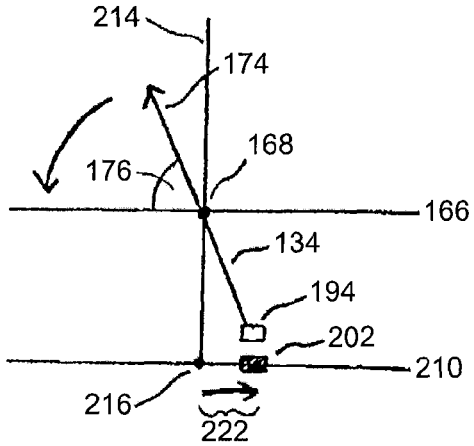
Figure 13:
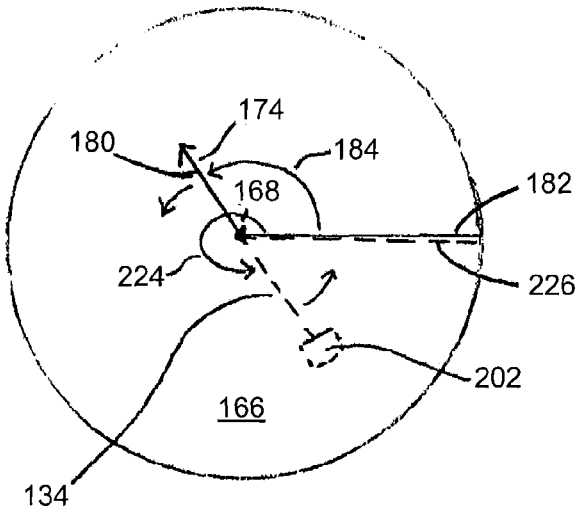
Figure 14:
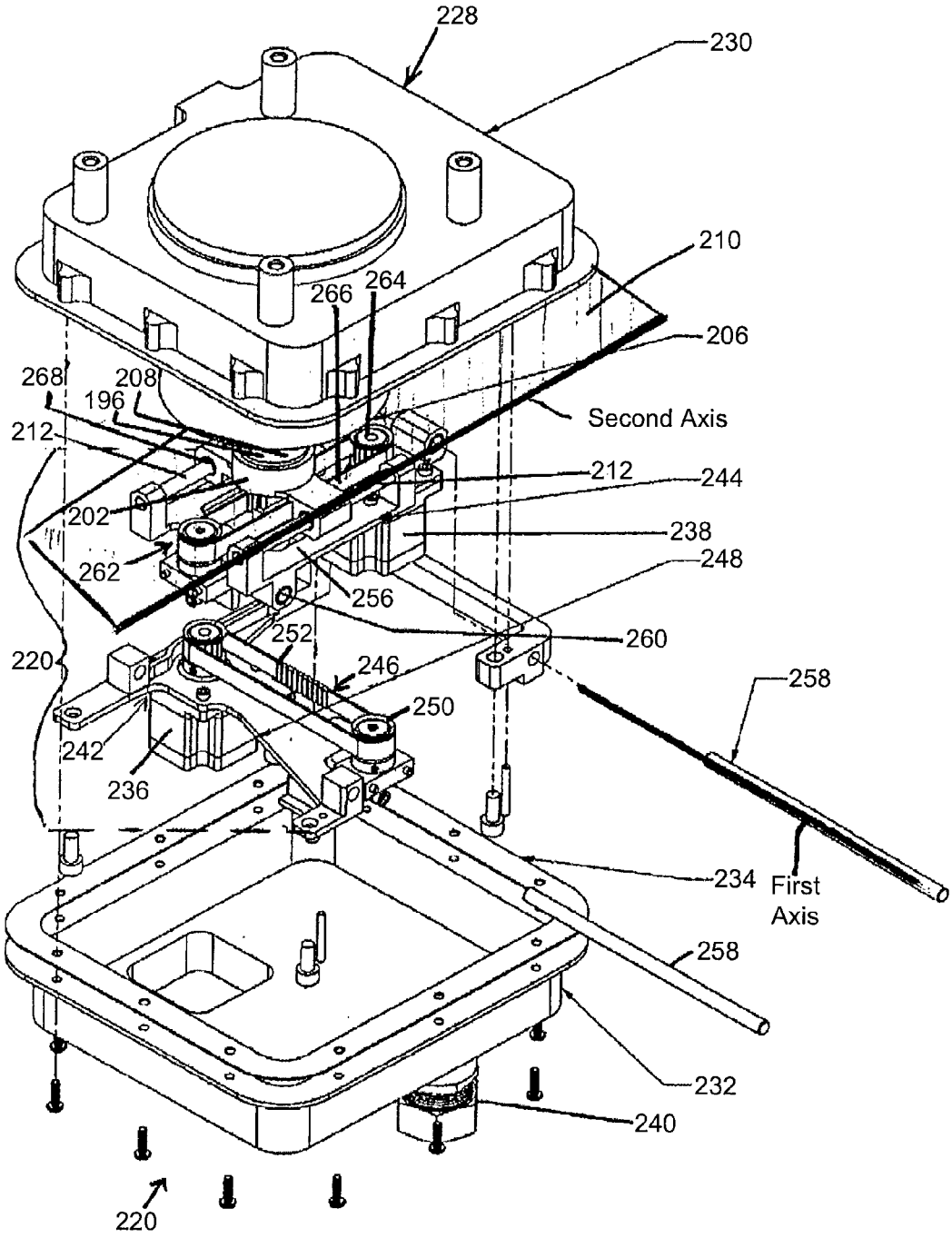
Figure 15A:
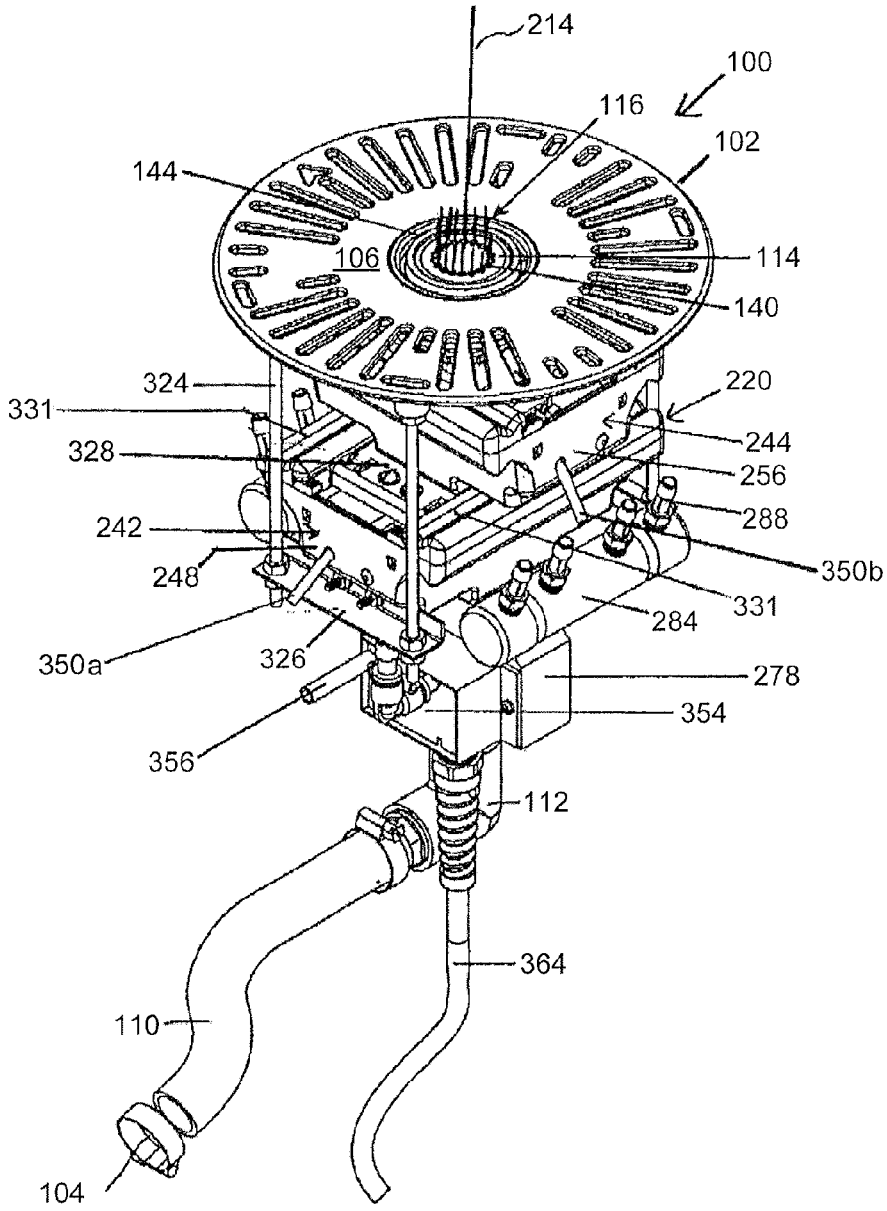
Figure 15B:
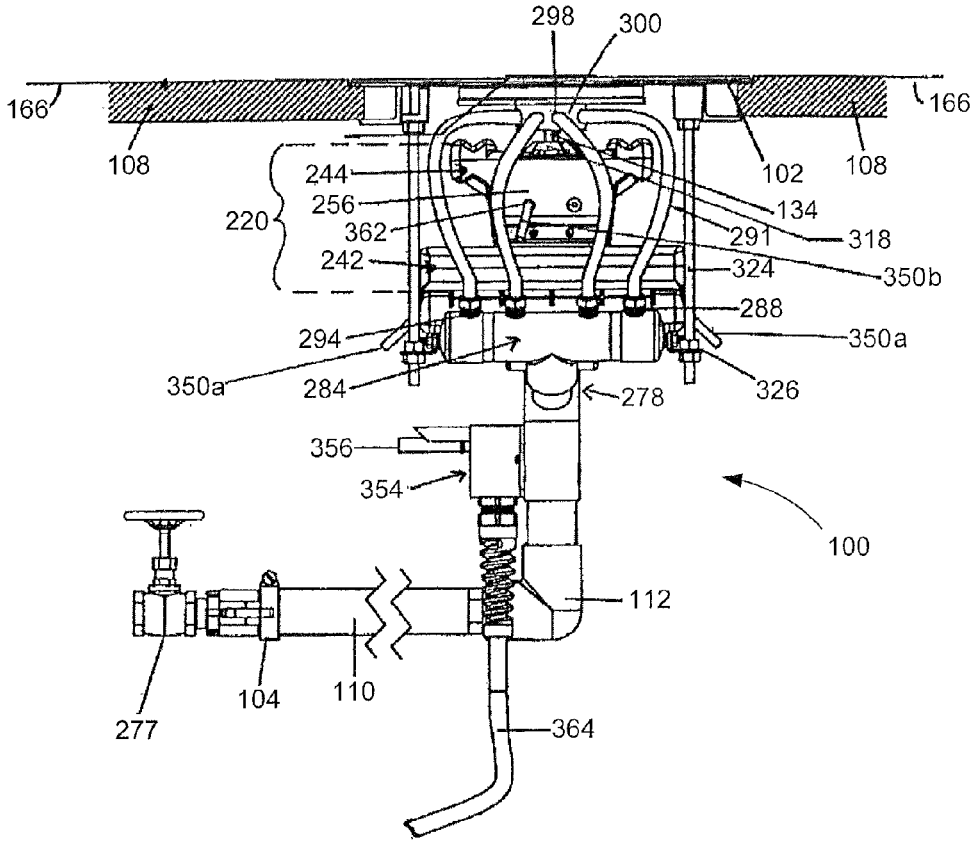

The skilled person in the art will understand that the drawings, described below, are for illustration purposes only. The drawings are not intended to limit the scope of the applicants' teachings in anyway:

FIG. 1, in a perspective view, illustrates a first embodiment of the articulated nozzle system;

FIG. 2, in a top view, illustrates the articulated nozzle system of FIG. 1;

FIG. 3, in a cut-away side view, illustrates the articulated nozzle system of FIG. 1, cut along line A-A of FIG. 2;

FIG. 4, in a top view, illustrates examples of the nozzle cap component and the upper flexible boot component of the articulated nozzle system of FIG. 1;

FIG. 5, in a side cut-away view, illustrates a cut along line B-B of FIG. 4;

FIG. 6, in a top view, illustrates an example of the spherical bearing component of the articulated nozzle system of FIG. 1;

FIG. 7 illustrates an exploded perspective view of the example nozzle system components illustrated in FIG. 5;

FIG. 8, in a cut-away side view, illustrates the example spherical bearing component of FIG. 6, cut along line A-A of FIG. 6;

FIG. 9, in a simplified side view, illustrates an example elevation angle component of the articulated nozzle system of FIG. 1;

FIG. 10, in a simplified top view, illustrates an example angular orientation component of the articulated nozzle system of FIG. 1;

FIG. 11*a*, in a simplified top view, illustrates an example polar coordinate system for defining the location of the nozzle cap driver component relative to the driver support plane;

FIG. 11*b*, in a simplified top view, illustrates an example Cartesian coordinate system for defining the location of the nozzle cap driver component relative to the driver support plane;

FIG. 12, in a simplified side view, illustrates an example of the movement of the elevation angle of the average flow direction component relative to the movement of the nozzle cap driver component;

FIG. 13, in a simplified top view, illustrates an example of the movement of the angular orientation of the average flow direction component relative to the movement of the nozzle cap driver component;

FIG. 14 illustrates an exploded perspective view of an example of the drive module component and the nozzle cap driver component of the articulated nozzle of FIG. 1;

FIG. 15*a*, in a perspective view, illustrates a second embodiment of the articulated nozzle system;

FIG. 15*b*, in a side view, illustrates the articulated nozzle system of FIG. 15*a;*

Figure 16:
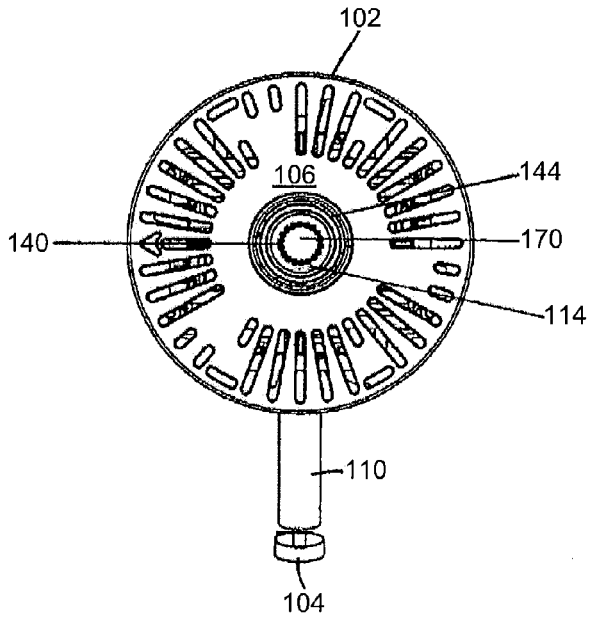

FIG. 16, in a top view, illustrates the articulated nozzle system of FIG. 15*a;*

Figure 17:
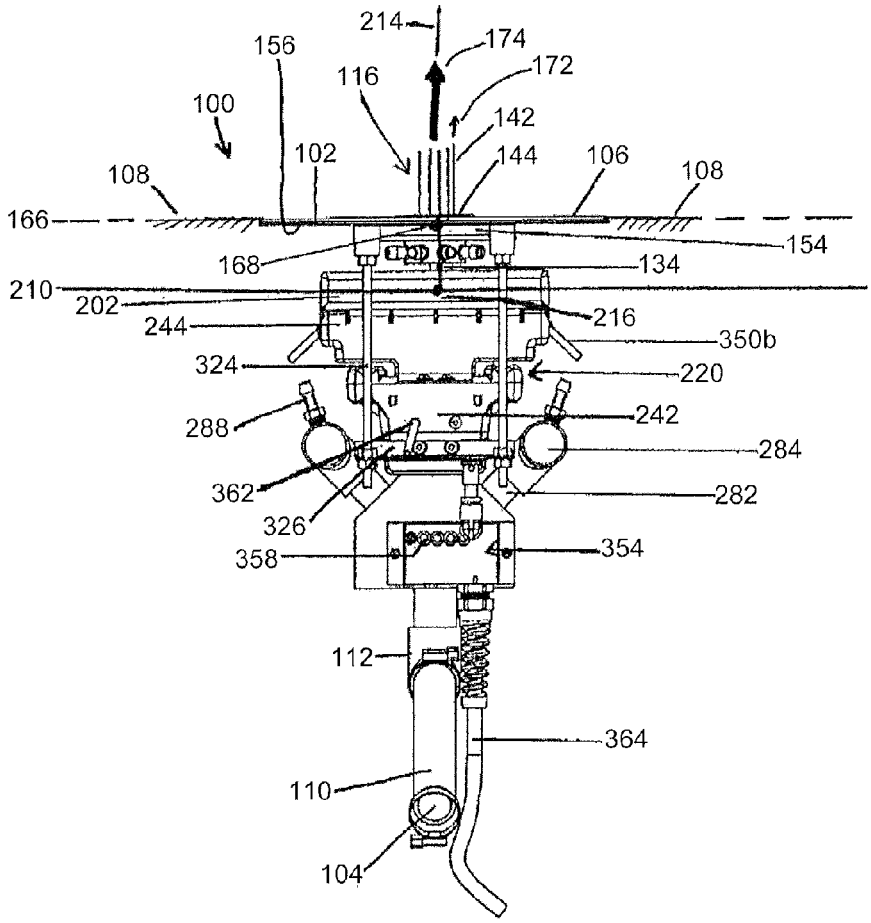

FIG. 17, in a front view, illustrates the articulated nozzle system of FIG. 15*a;*

Figure 18:
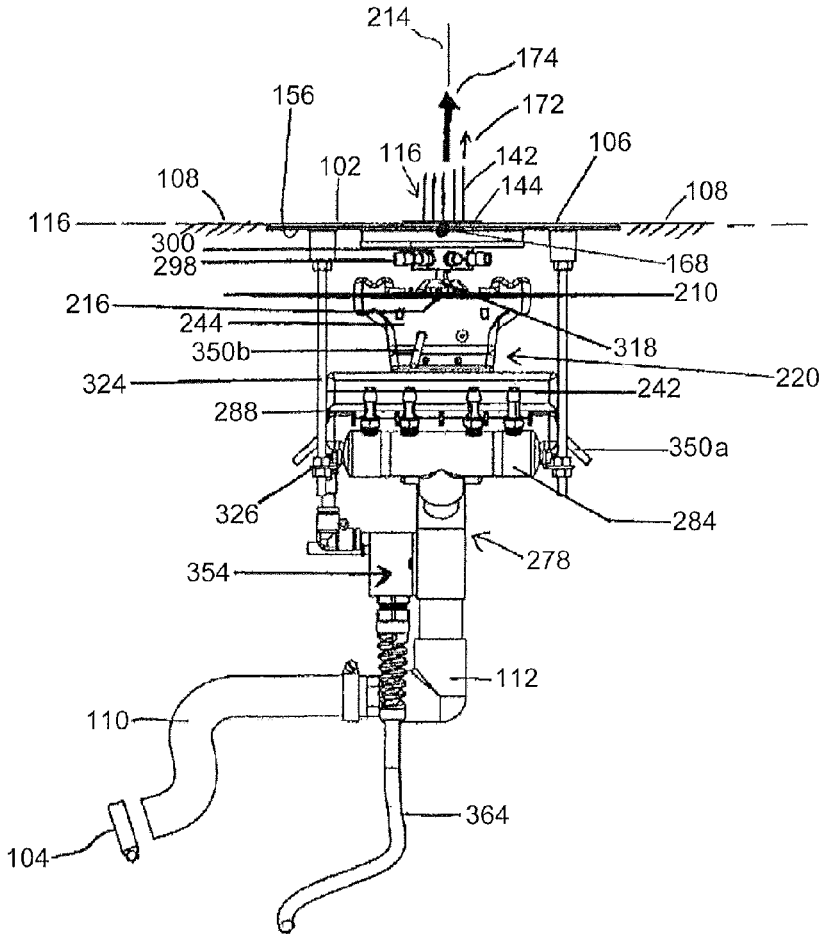

FIG. 18, in a side view, illustrates the articulated nozzle system of FIG. 15*a;*

Figure 19:
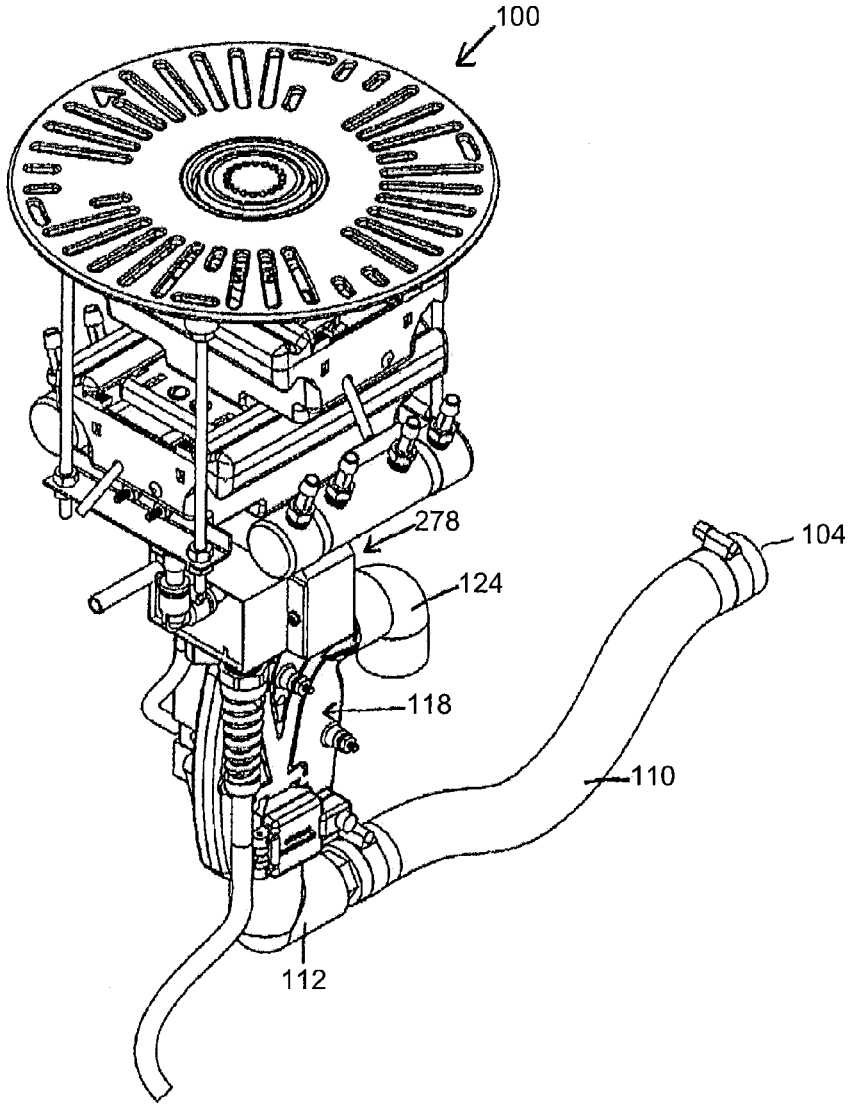
Figure 20:
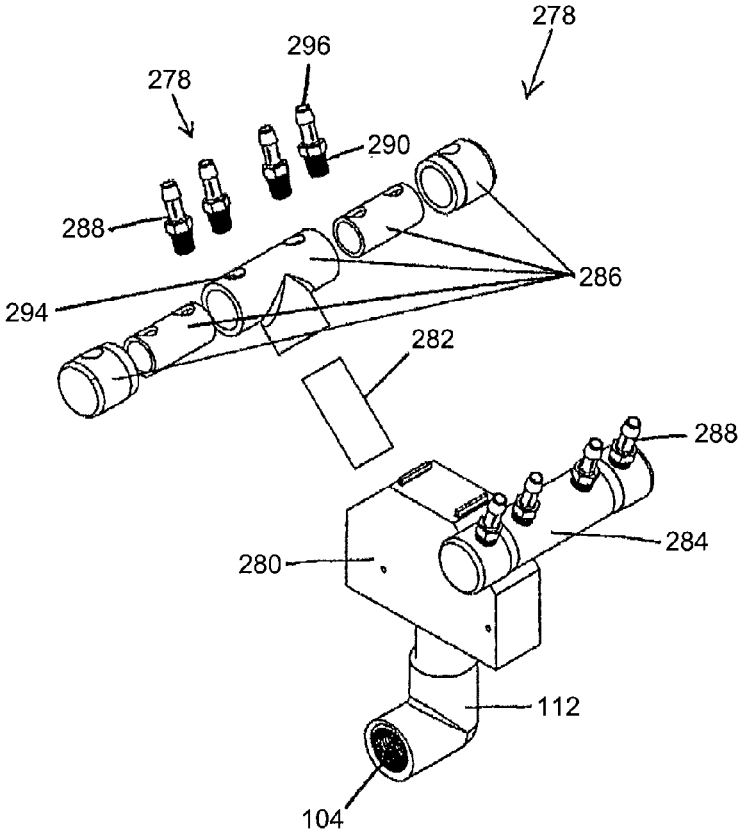

FIG. 19, in a perspective view, illustrates the articulated nozzle system of FIG. 15*a* with the addition of a flow sequencing device component;

FIG. 20, in a partially exploded perspective view, illustrates an example wye assembly component of the articulated nozzle of FIG. 15*a;*

Figure 21:
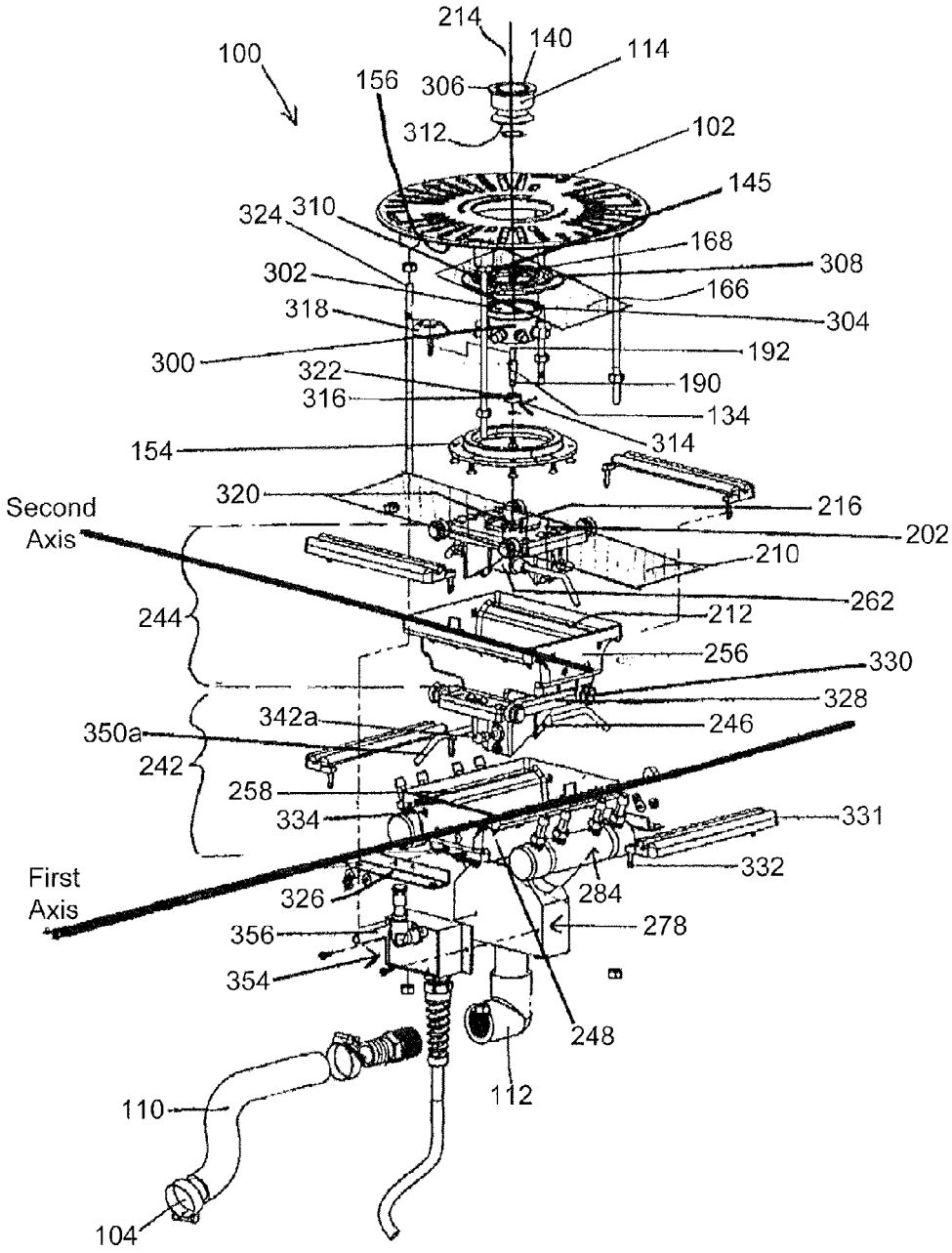

FIG. 21, in an exploded perspective view, illustrates the articulated nozzle of FIG. 15*a;*

Figure 22:
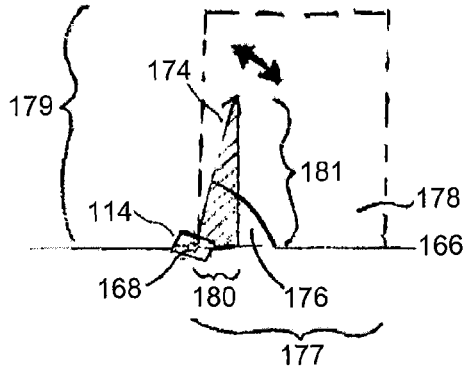

FIG. 22, in a simplified side view, illustrates an example elevation angle component of the articulated nozzle system of FIG. 15*a;*

Figure 23:
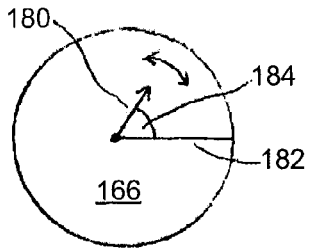

FIG. 23, in a simplified top view, illustrates an example angular orientation component of the articulated nozzle system of FIG. 15*a;*

Figure 24A:
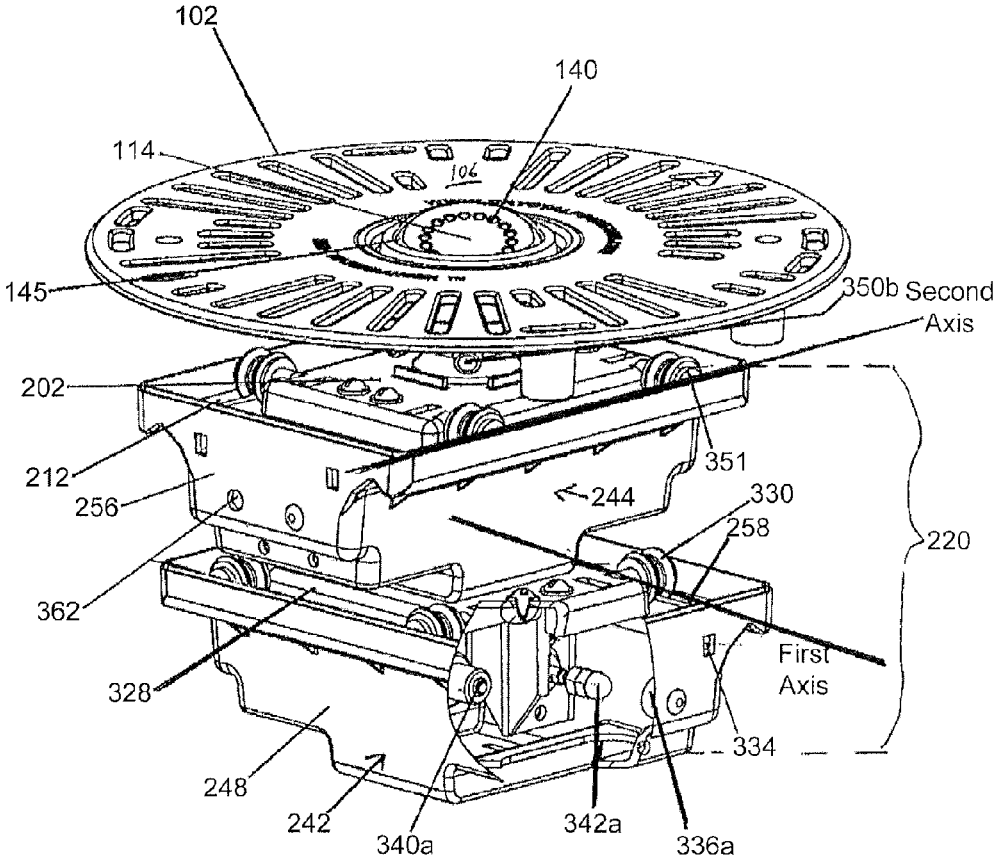

FIG. 24*a*, in a perspective partial cut-away view, illustrates example components of the articulated nozzle system of FIG. 15*a;*

Figure 24B:
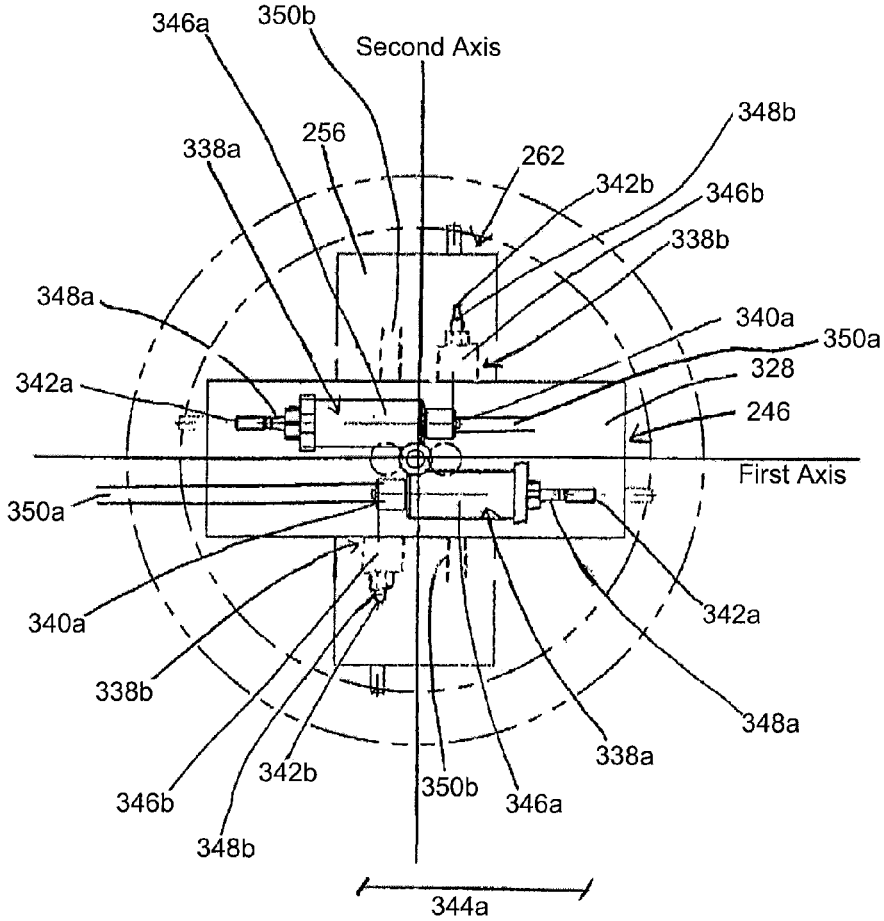

FIG. 24*b*, in a simplified bottom view, illustrates example actuation assembly components of the articulated nozzle system of FIG. 15*a;*

Figure 25:
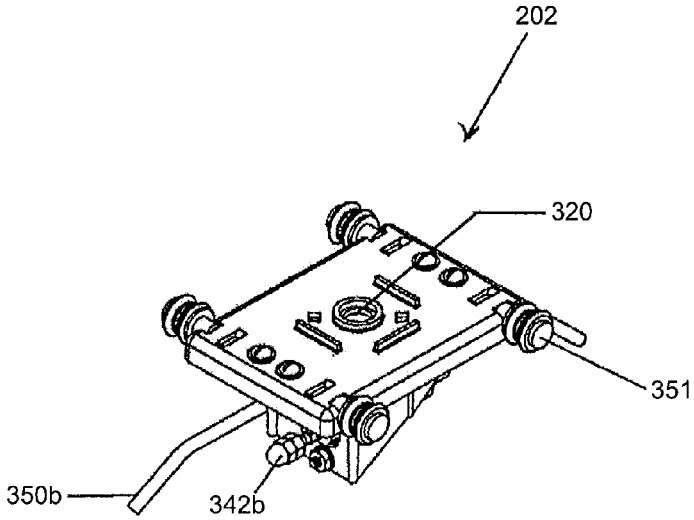

FIG. 25, in a perspective view, illustrates an example nozzle cap driver component of the articulated nozzle of FIG. 15*a;*

Figure 26:
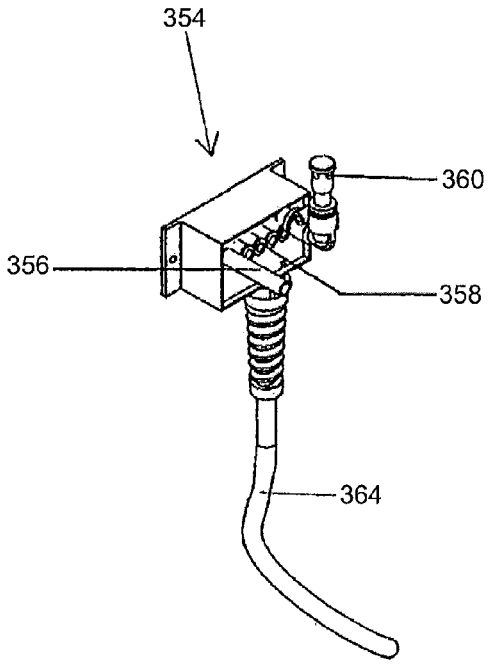

FIG. 26, in a perspective view, illustrates an example solenoid assembly component of the articulated nozzle of FIG. 15*a;*

Figure 27A:
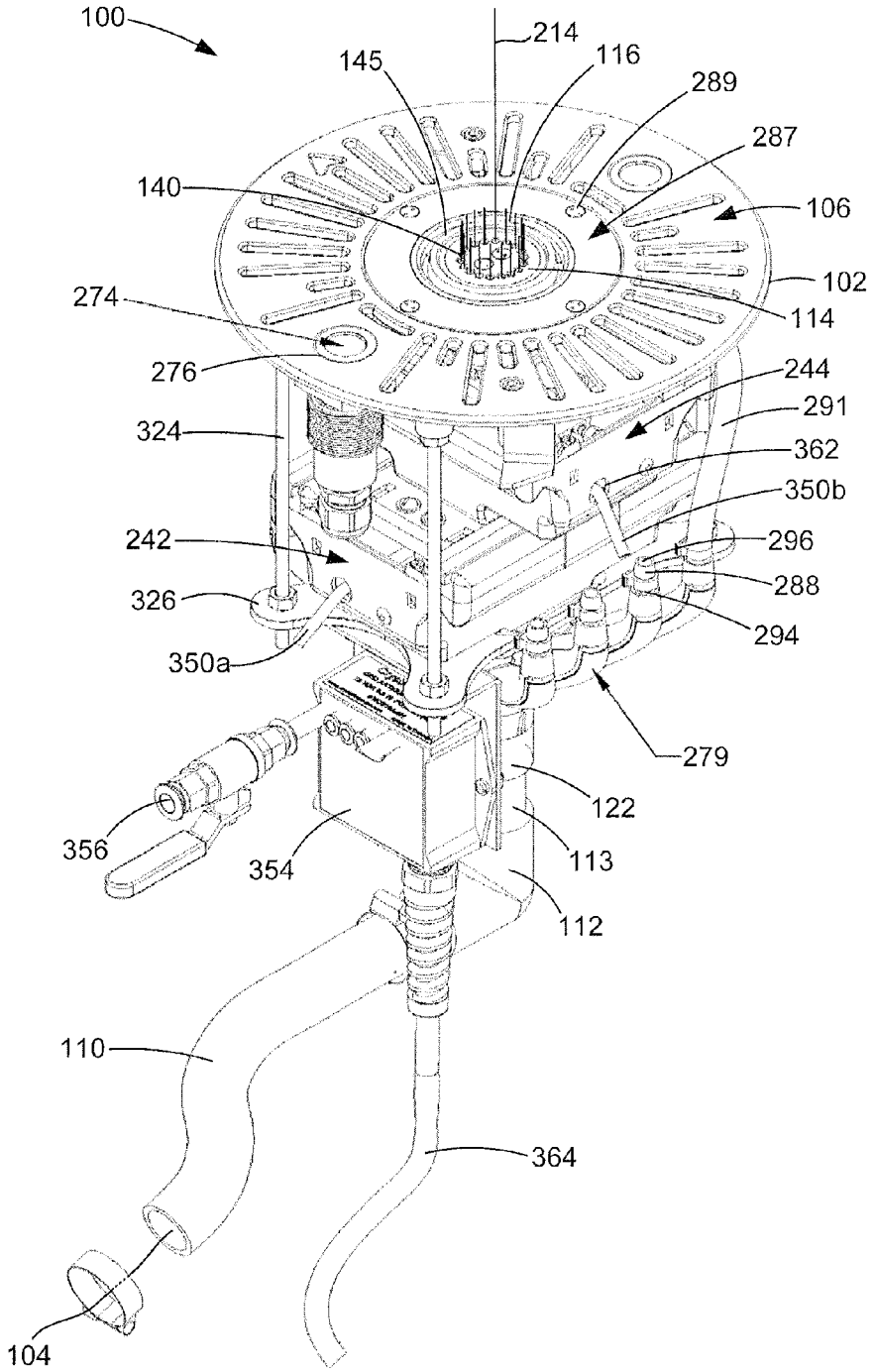
Figure 27B:
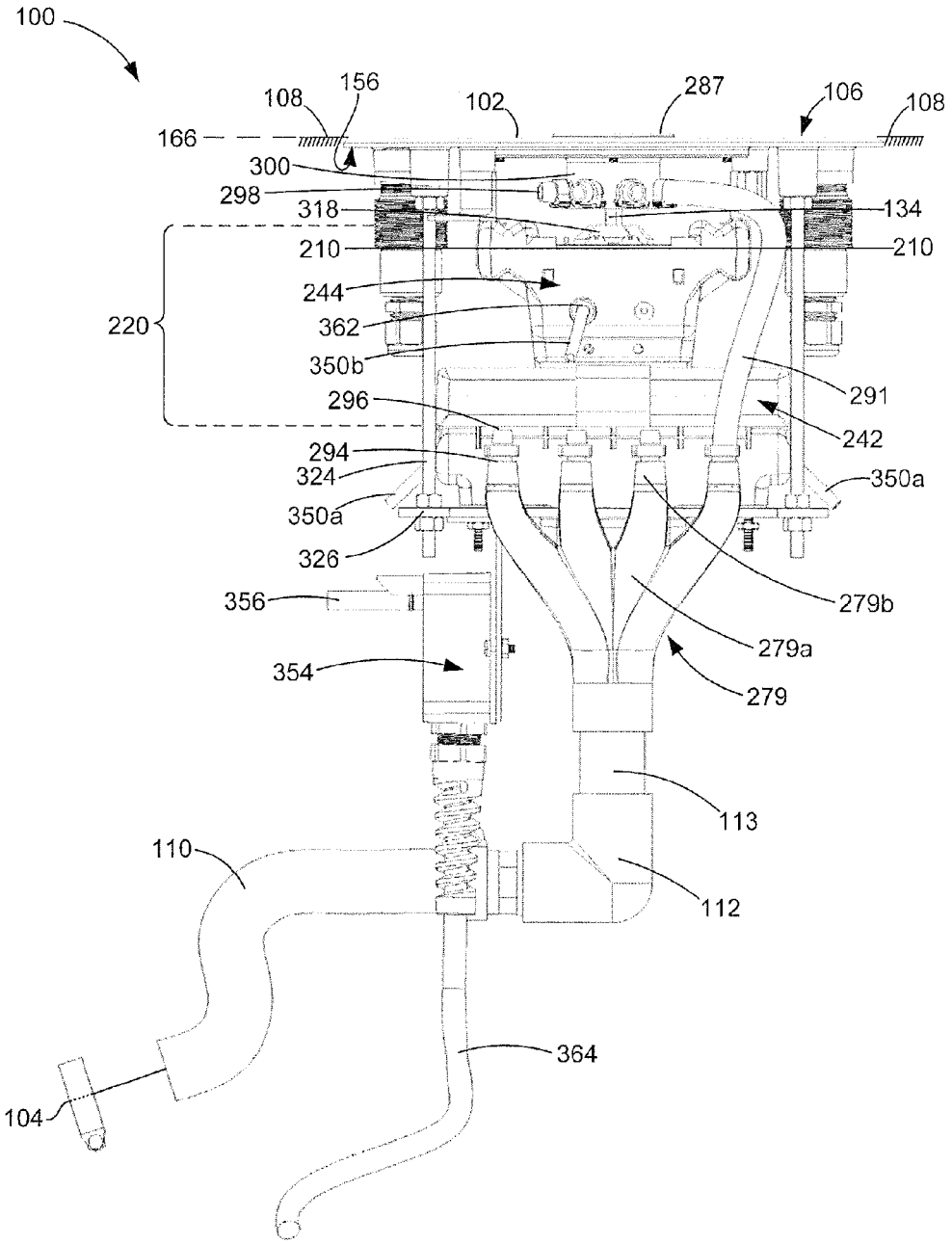

FIG. 27*a*, in a perspective view, illustrates a third embodiment of the articulated nozzle system;

FIG. 27*b*, in a side view, illustrates the articulated nozzle system of FIG. 27*a;*

Figure 28:
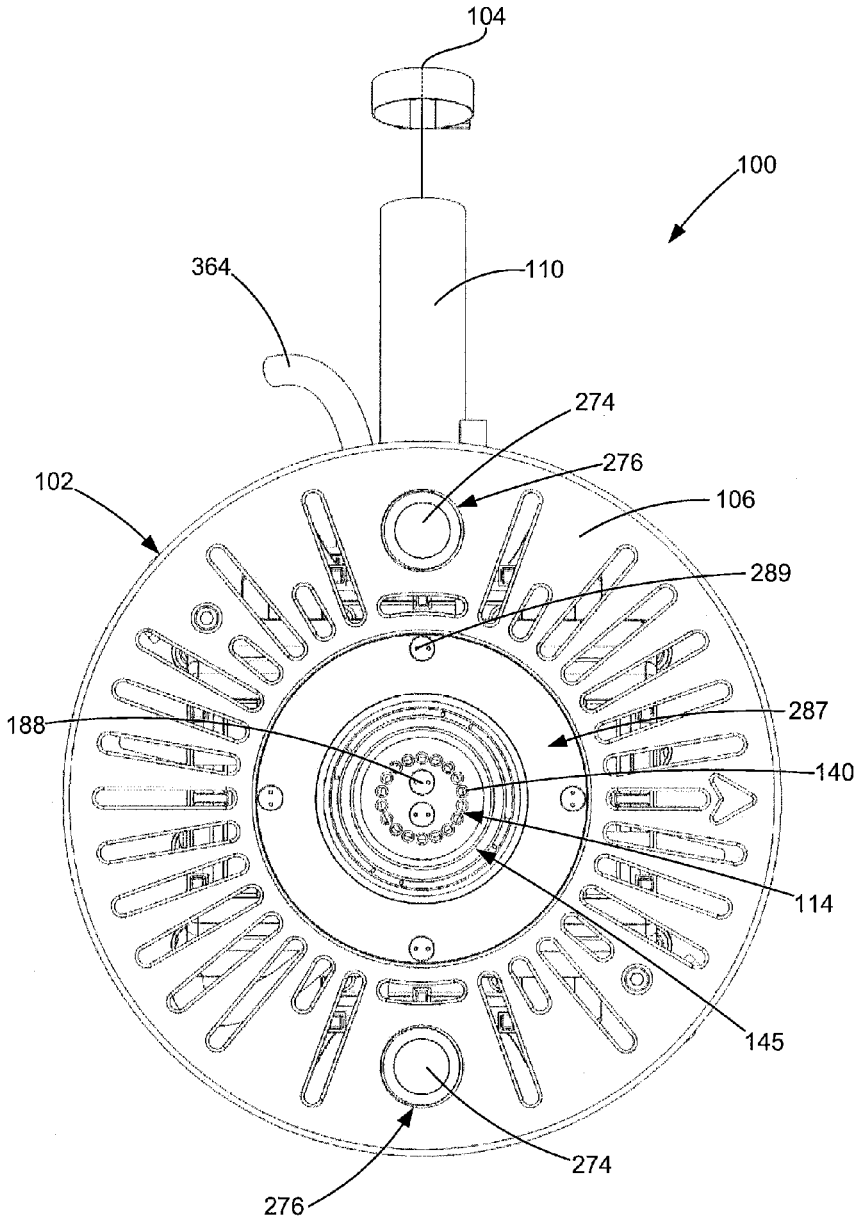

FIG. 28, in a top view, illustrates the articulated nozzle system of FIG. 27*a;*

Figure 29:
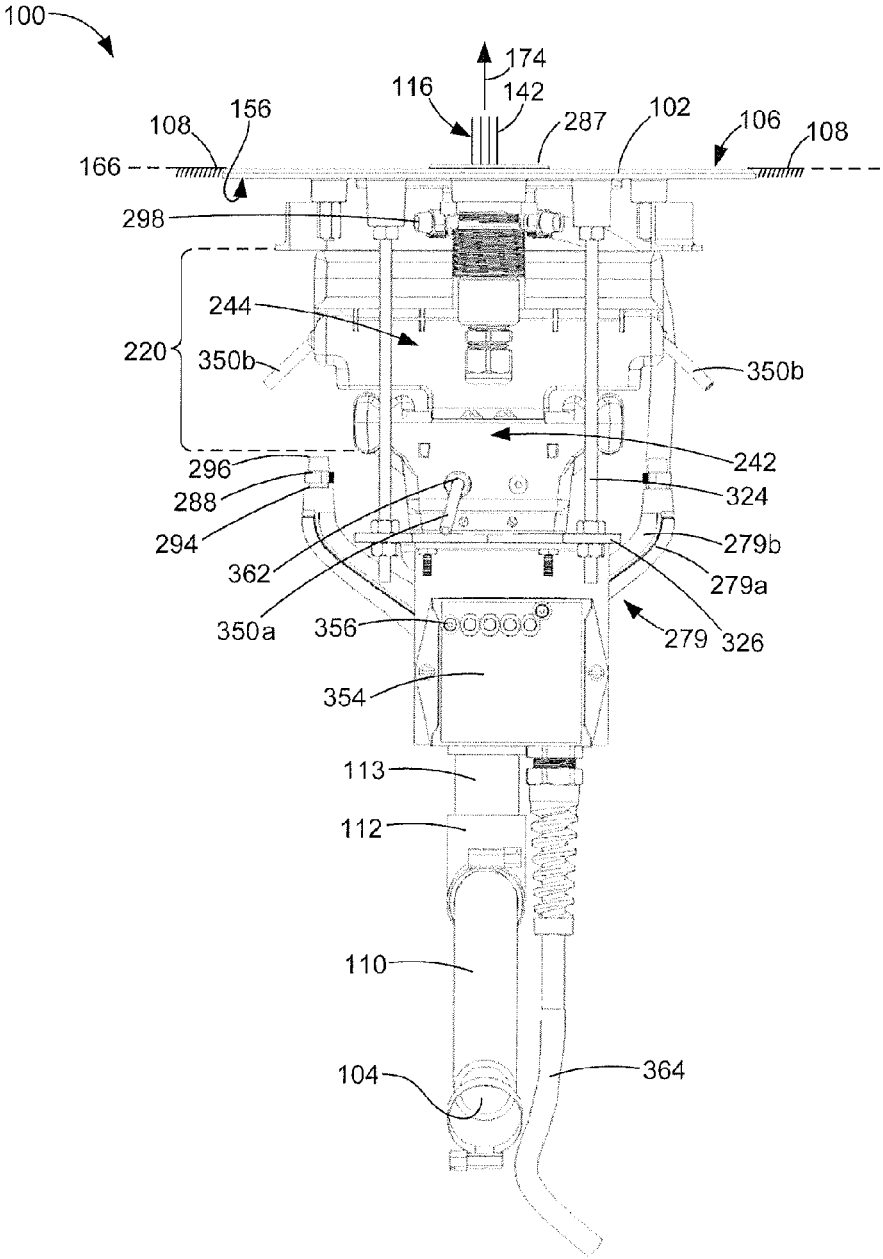

FIG. 29, in a front view, illustrates the articulated nozzle system of FIG. 27*a;*

Figure 30B:
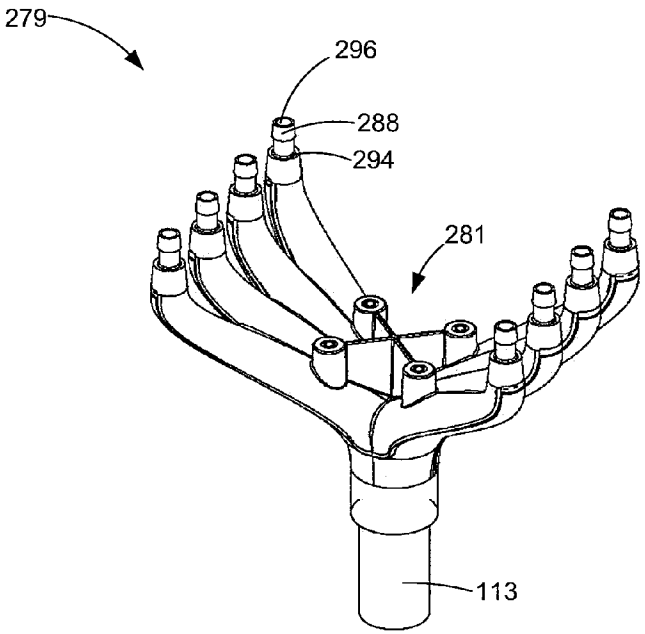
Figure 30A:
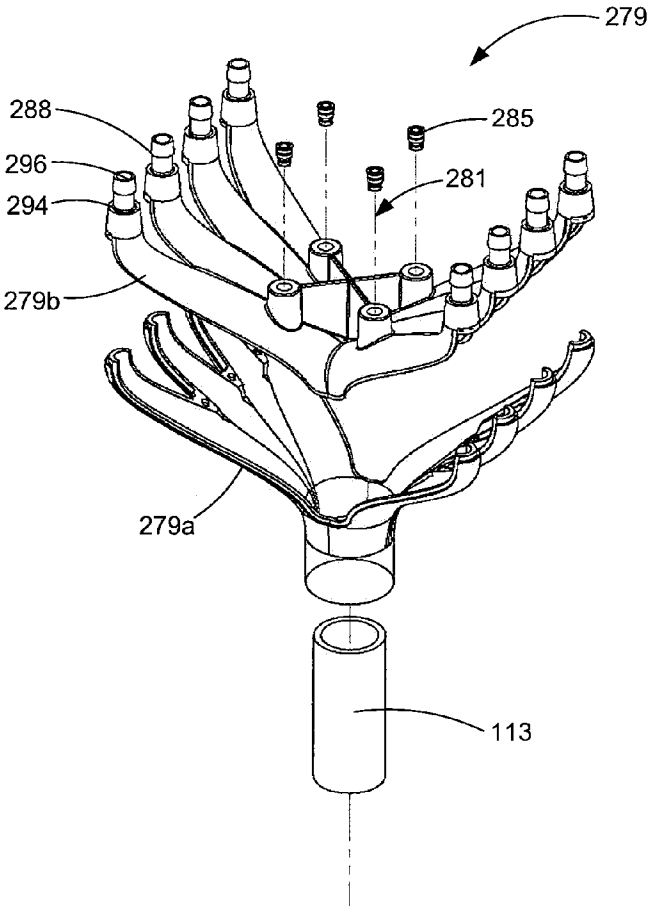

FIG. 30*a*, in an exploded perspective view, illustrates an example wye assembly component of the articulated nozzle of FIG. 27*a;*

Figure 31:
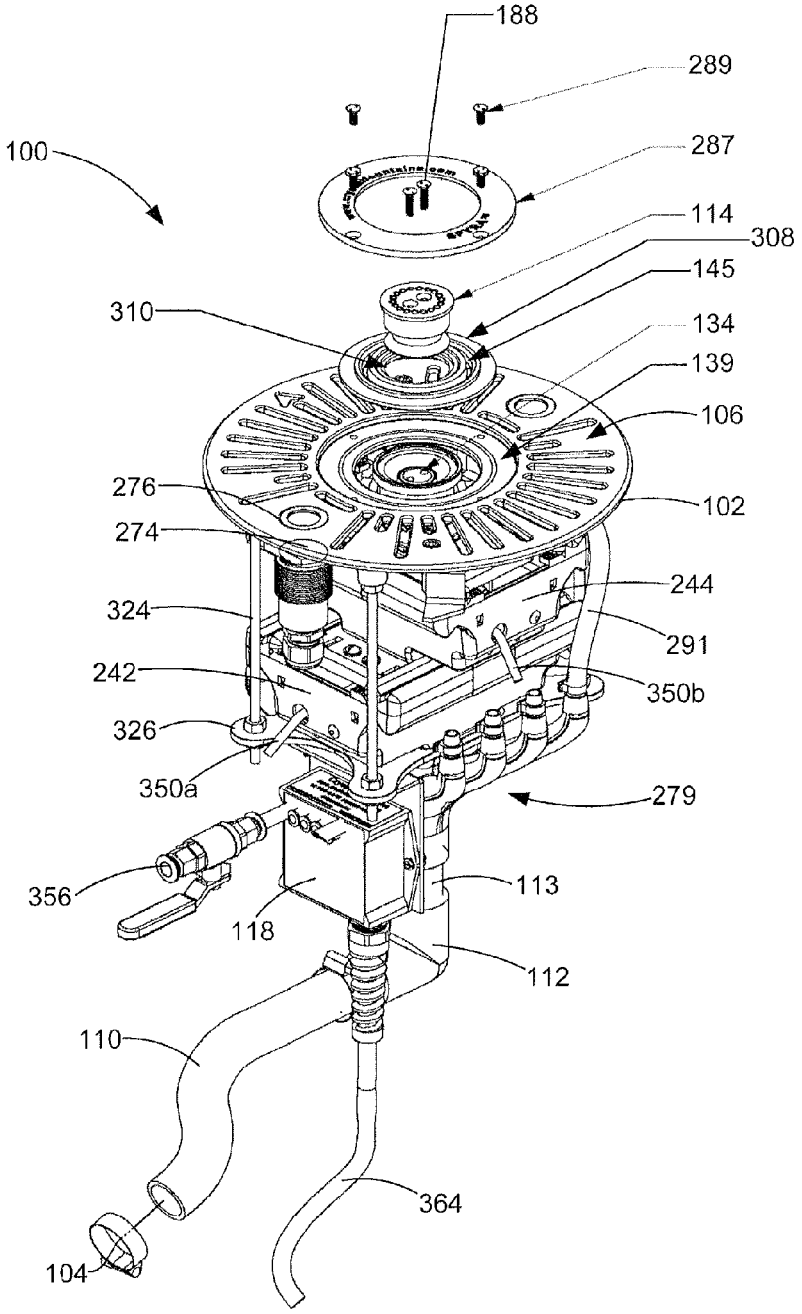

FIG. 30*b*, in a perspective view, illustrates the wye assembly component of FIG. 30*a*; and FIG. 31, in a partially exploded perspective view, illustrates the articulated nozzle system of FIG. 27*a*.

DESCRIPTION OF VARIOUS EMBODIMENTS

Multiple embodiments of the invention are described below. For clarity, the same reference numerals are used to designate elements of the different embodiments that are analogous to one another. For brevity, the description of previously discussed figures is not repeated.

Referring to FIG. 1, there is illustrated a perspective view of an example articulated nozzle system 100. The ends of articulated nozzle system 100 can comprise slab hanger 102 and water inlet 104.

In FIG. 2, there is illustrated a top view of articulated nozzle system 100, showing top surface 106 of slab hanger 102.

FIG. 3 shows a cut-away side view of articulated nozzle system 100, taken along line A-A of FIG. 2. As illustrated by FIG. 3, slab hanger 102 can be placed within existing surface 108. Existing surface 108 can consist of natural earth, a concrete slab, the floor of a pool, or the like. The articulated nozzle system 100 can be placed into existing surface 108 such that the top surface 106 of slab hanger 102 can be flush with existing surface 108 (as shown in FIG. 3). In another embodiment of the invention, slab hanger 102 can be recessed into, or protrude out from, existing surface 108.

Referring back to FIG. 1, the water supply entering articulated nozzle system 100 can enter the system though water inlet 104. In one embodiment, water inlet 104 can be an opening in intake pipe 110. Intake pipe 110 can convey water received by water inlet 104 to the remainder of articulated nozzle system 100. In the embodiment shown in FIG. 1, the articulated nozzle system 100 can be connected to intake pipe 110 by an approximately 90-degree pipe elbow (pipe elbow 112). However, intake pipe 110 can be connected to articulated nozzle system 100 in many different orientations. Alternatively, water inlet 104 can receive the water supply so that it is conveyed directly into the remainder of the articulated nozzle system 100. After entering water inlet 104, the water can then pass through articulated nozzle system 100 to be received by nozzle cap 114. The water can then exit nozzle cap 114. The water can exit nozzle cap 114 in the form of exiting water 116, which can be visible to the end user. To allow the water to pass through articulated nozzle system 100, water inlet 104 and nozzle cap 114 can be in fluid communication with one another.

Once the water enters articulated nozzle system 100 at water inlet 104, the water can pass through flow control device 118. Flow control device 118 can act as a switch, either allowing or preventing water flow through a specific route. Electrical signals (supplied to the unit by sequencing wire 120) can convert electrical energy into mechanical movements that control water flow.

In one embodiment, flow control device 118 can comprise a sequencing switch. Sequencing switches, such as Crystal Fountain's Choreoswitch™, are known in the art. Such a sequencing switch can act as a 3-way solenoid valve. In a first position and a first operation mode, the valve can operate to divert water flow into transition pipe 122. In a second position and a second operational mode, the valve can operate to divert the water flow through output pipe 124 (FIG. 9), diverting water out of the articulated nozzle system 100. Articulated nozzle system 100 can be rapidly changed between modes. Switching between the two modes at various rates can be used to sequence the water projection of exiting water 116, as can be seen by the end user.

In another embodiment, flow control device 118 can comprise a control valve or similar device affecting water supply. Such devices are known in the art for adjusting the height of exiting water that is visible to the end user.

The water exiting flow control device 118 can then enter nozzle chamber 126. In one embodiment, water exiting flow control device 118 can enter nozzle chamber 126 via transition pipe 122. Nozzle chamber 126 can be encased by nozzle chamber housing 128.

In the embodiment shown in FIG. 3, nozzle chamber 126 can be enclosed by nozzle chamber housing 128 and the lower face of bearing housing 130. As water pressure builds within nozzle chamber 126, water can escape nozzle chamber 126 through at least one connector shaft aperture 132 in connector shaft 134. The water can then pass through at least one connector shaft aperture 132 into inner void 136 of spherical bearing 138.

As shown in FIG. 2, nozzle cap 114 can consist of at least one exit aperture 140. As the water pressure builds-up in inner void 136 of spherical bearing 138 (FIG. 3), the water can escape the void through at least one exit aperture 140 (FIG. 2). Exiting water 116 that has passed through one exit aperture 140 can comprise one exiting stream 142 (FIG. 3). A multitude of exit apertures (140) can be used to provide the desired visual effect of exiting water 116. Exiting water 116 that has passed through multiple exit apertures can comprise multiple exiting streams (142), as shown in FIG. 3. In one embodiment, nozzle cap 114 can be replaceable with nozzle caps comprising different exit aperture (140) arrangements. The use of different nozzle caps can be employed to vary the shape and/or number of exiting streams (142) comprising exiting water 116.

FIG. 4 illustrates a top view of nozzle cap 114 and upper flexible boot 144. As shown in FIG. 4, nozzle cap 114 can be surrounded by upper flexible boot 144. In one embodiment of the invention, nozzle cap 114 can lie in substantially the same horizontal plane as upper flexible boot 144 during non-actuation.

FIG. 5 illustrates a cut-away side view of the embodiment illustrated in FIG. 4, taken along line B-B of FIG. 4. As shown in FIG. 5, lower flexible boot 146 can enclose the bottom surface of spherical bearing 138.

In one embodiment, upper flexible boot 144 and lower flexible boot 146 can be made of a flexible and resilient material. Alternatively, upper flexible boot 144 and lower flexible boot 146 can be made of a fairly rigid material that is corrugated to allow for the movement of nozzle cap 114. In another embodiment, upper flexible boot 144 and lower flexible boot 146 can be made of a hydrophobic material so as to protect spherical bearing 138 from water damage. The boot material can be made of, but is not limited to, rubber.

Upper flexible boot 144 can be clamped between nozzle cap 114 and inner bearing 148 at the upper boot's proximal portion 310. Upper flexible boot 144 can be fixed onto the top surface of outer bearing 150 at the upper flexible boot's distal portion 308.

Lower flexible boot 146 can be clamped between connector shaft 134 and inner bearing 148 at its proximal portion 151 and can be fixed onto the lower surface of outer bearing 150 at the lower flexible boot's distal portion 153.

Upper flexible boot 144 and lower flexible boot 146 can cover pinch points and protect and seal components of spherical bearing 138 from water damage, while still allowing for movement of nozzle cap 114.

FIG. 6 shows a top view of spherical bearing 138. Spherical bearing 138 can comprise an inner void 136, defined by the inner surface of inner bearing 148. Spherical bearing 138 can also include intermediate bearing 152, outer bearing 150, and bearing housing 130. Bearing housing 130 can be fixedly attached to lower surface 156 of slab hanger 102 (FIG. 3). As illustrated in FIG. 3, in one embodiment, nozzle cap support can comprise spherical bearing 138 and bearing housing 130. These components of nozzle cap support can support nozzle cap 114 against gravitational forces, for example.

FIG. 7 provides an exploded perspective view of one embodiment of spherical bearing 138, along with a perspective view of connector shaft 134. In the illustrated embodiment, at least one inner insert 158 can be located at the interface between inner bearing 148 and intermediate bearing 152. Inner insert 158 can be made of polytetrafluoroethylene (PTFE), or a similar material, as is known in the art. The use of materials such as PTFE for use within spherical bearings is known in the art. Such inserts can facilitate low-friction contact and can minimize the wear of contact surfaces within bearings.

In this particular embodiment, at least one outer insert 164 can be placed at the interface between intermediate bearing 152 and outer bearing 150.

FIG. 8 shows an illustration of spherical bearing 138 rotated relative to nozzle cap base plane 166, wherein nozzle cap base plane 166 intersects central pivot point 168. Spherical bearing can have a central pivot point 168. The component parts of spherical bearing 138 can be rotated about central pivot point 168. Central pivot point 168 can be the point about which the component parts of spherical bearing 138 rotate relative to one another.

In one embodiment of the invention, the central pivot point can be the center of gravity of spherical bearing 138. Intermediate bearing 152 can rotate above or below nozzle cap base plane 166 about the central pivot point 168, relative to outer bearing 150. Inner bearing 148 can also rotate above or below nozzle cap base plane 166, and about central pivot point 168 of spherical bearing 138, relative to intermediate bearing 152. Therefore, the total rotation of spherical bearing 138 above or below nozzle cap base plane 166 can be defined by the cumulative rotation of intermediate bearing 152 relative to outer bearing 150 and inner bearing 148 relative to intermediate bearing 152. During rotation of spherical bearing 138, outer bearing 150 can remain stationary. In one embodiment, as illustrated in FIG. 3, nozzle cap support can comprise spherical bearing 138 and bearing housing 130. In this embodiment, fixed support portion of nozzle cap support can comprise bearing housing 130 and outer bearing 150. Therefore, during rotation of spherical bearing 138, fixed support portion can remain stationary. Bearing housing 130 can be fixedly attached to lower surface 156 of slab hanger 102. Outer bearing 150 can be fixedly attached to bearing housing 130. These fixed connections can allow bearing housing 130 and outer bearing 150 to remain stationary during rotation of spherical bearing 138.

Referring back to FIG. 8, in a particular embodiment of the invention, intermediate bearing 152 can rotate 5 degrees above or below nozzle cap base plane 166, relative to outer bearing 150. In this particular embodiment, inner bearing 148 can also rotate 10 degrees above or below nozzle cap base plane 166, relative to outer intermediate bearing 152. Therefore, in this particular embodiment, spherical bearing 138 can rotate 15 degrees above or below nozzle cap base plane 166, about central pivot point 168. In one embodiment of the invention, nozzle cap 114 can be fixedly connected to spherical bearing 138 via connector shaft 134. Therefore, the movement of the nozzle cap can be limited to the range of rotation of spherical bearing 138.

In an alternative embodiment of the invention, the spherical bearing can comprise an inner bearing 148 and an outer bearing 150, without intermediate bearing 152. In this embodiment, inner bearing 148 can rotate relative to outer bearing 150. In this particular embodiment, inner bearing 148 can rotate in the range of 0 to 15 degrees above or below nozzle cap base plane 166, relative to outer bearing 152.

In some embodiments of the invention where nozzle cap 114 is coupled to inner bearing 148, via connector shaft 134 (as illustrated in FIG. 5), the rotation of spherical bearing 138 can result in rotations of nozzle cap 114 that are substantially equal to the rotation of connector shaft 134 about central pivot point 168. However, a person skilled in the art could appreciate that spherical bearing 138, connector shaft 134 and nozzle cap 114 could be coupled to one another such that the rotation of connector shaft 134 about spherical bearing 138 contributes to the rotation of nozzle cap 114, but is not necessarily substantially equal to the rotation of nozzle cap 114.

FIG. 3 illustrates a notional stationary nozzle cap base plane 166. In the embodiment illustrated in FIG. 3, this nozzle cap base plane 166 can be defined by a plane intersecting central pivot point 168. In one embodiment of the invention, central pivot point 168 can be the central point of rotation of spherical bearing 138, wherein the central point of rotation can be the point about which the component parts of spherical bearing 138 rotate relative to one another. A person skilled in the art would appreciate that, for reference purposes, nozzle cap base plane 166 could be positioned at any location within articulated nozzle system 100, so long as it is parallel in orientation to the nozzle cap base plane illustrated in FIG. 3. For example, nozzle cap base plane 166 can be defined by top surface 106 of slab hanger 102, or by a plane intersecting an initial location of top surface 170 of nozzle cap 114.

Each exiting stream (142) exiting an exit aperture (140) can have a stream flow direction 172, which represents the direction of water traveling away from nozzle cap base plane 166. The exiting water 116 can have an average flow direction 174. The average flow direction 174 can be the average of the individual exiting stream flow directions (172).

The average flow direction 174 can be measured relative to nozzle cap base plane 166. Average flow direction 174 can be defined by two variable angles, both angles being measured relative to nozzle cap base plane 166.

FIG. 9 provides a simplified side view of nozzle cap 114 and central pivot point 168 illustrated in FIG. 3. The first angle can be an elevation angle 176, as illustrated in FIG. 9. Elevation angle 176 represents the angle between average flow direction 174 and nozzle cap base plane 166. As illustrated in FIG. 9, elevation angle 176 can rotate between variable angles, such as first elevation angle **176*a* and second elevation angle 176*b*. Rotation of nozzle cap 114 about central pivot point 168 can change the elevation angle 176 of average flow direction 174**.

As illustrated in FIG. 9, average flow direction 174 lies in a trajectory plane 178, wherein trajectory plane 178 is orthogonal to nozzle cap base plane 166. Trajectory plane 178 can be definable by Cartesian coordinates originating at central pivot point 168, where a first dimension 177 is parallel to the nozzle cap base plane 166, and a second dimension 179 is orthogonal to the nozzle cap base plane 166. Thus, average flow direction 174, which lies in the trajectory plane 178, can be resolved to be defined by a trajectory plane base component 180 parallel to first dimension 177 and a trajectory plane elevation component 181 parallel to second dimension 179. Therefore, the vector representation of average flow direction 174 can be written as (trajectory plane base component 180, trajectory plane elevation component 181).

FIG. 10 illustrates a top view of the simplified components illustrated in FIG. 9. The orientation of trajectory plane base component 180 of average flow direction 174, relative to base plane reference line 182 on nozzle cap base plane 166, can be defined by angular orientation 184. Angular orientation 184 can rotate within nozzle cap base plane 166 relative to nozzle cap base plane reference line 182. This rotation of angular orientation 184 can occur about central pivot point 168. For example, as illustrated in FIG. 10, trajectory plane base component 180 has a first angular orientation 184*a*, which can be moved to a second angular orientation 184*b*. Rotation of nozzle cap 114 about central pivot point 168 can change the angular orientation 184 of trajectory plane base component 180 of average flow direction 174.

In a particular embodiment, the elevation angle 176 of average flow direction 174 (FIG. 9) can be in the range of 75 to 90 degrees. In a further embodiment of the invention, angular orientation 184 (FIG. 10) can be in the range of 0 to 360 degrees. This embodiment corresponds to the use of a spherical bearing 138 having a total range of rotation limited to between 0 and 15 degrees above or below nozzle cap base plane 166 (as outlined above).

The nozzle cap 114 can move such that elevation angle 176 and angular orientation 184 of the average flow direction 174 of exiting water 116 (FIG. 3) can be adjusted. The assembly for moving nozzle cap 114 to achieve this change in average flow direction 174 will now be discussed.

As shown in FIG. 3, nozzle cap 114 can be coupled to connector shaft 134, by connecting rod 188. In one embodiment of the invention, nozzle cap 114 can be fixedly coupled to connector shaft 134, via connecting rod 188. Connecting rod 188 can be, but is not limited to, a threaded rod. Therefore, any movement of connector shaft 134 can move nozzle cap 114.

Connector shaft 134 can pass through spherical bearing 138, thereby coupling spherical bearing 138 to nozzle cap 114. Spherical bearing 138 can provide a central pivot point 168 for the coupled combination of connector shaft 134 and nozzle cap 114. As previously discussed, central pivot point 168 can be located at the center of rotation of spherical bearing 138. Connector shaft 134 can rotate about central pivot point 168. In one embodiment, connector shaft 134 can pass through central pivot point 168. However, a person skilled in the art would appreciate that connector shaft 134 need not pass directly through central pivot point 168 in order to rotate about central pivot point 168.

As first end 190 of connector shaft 134 is moved, connector shaft 134 can rotate about central pivot point 168. Due to the coupled connection between second end 192 of connector shaft 134 and nozzle cap 114, movement of first end 190 can also move nozzle cap 114. Through this movement sequence nozzle cap 114 can be moved so as to vary elevation angle 176 (FIG. 9) and angular orientation 184 (FIG. 10) of the average flow direction 174. Therefore, movement of first end 190 can vary the average flow direction of exiting water 116 seen by the end user, as defined by variable average flow direction 174 (FIG. 3).

As illustrated in FIG. 3, first end 190 of connector shaft 134 can comprise a driven magnet 194. Driven magnet 194 (located in nozzle chamber 126) can be within close proximity to drive magnet 196 (located in drive enclosure 228). Driven magnet 194 can have a first magnetic field and drive magnet 196 can have a second magnetic field. In one embodiment of the invention, the first magnetic field can be opposite in polarity to the second magnetic field. In this particular embodiment, due to the opposite polarity of the two magnetic fields, attractive forces between the two magnets can cause movements of drive magnet 196 to be followed by driven magnet 194. A person skilled in the art would also appreciate that first magnetic field can have the same polarity as second magnetic field, and that driven magnet 194 can be moved by the repulsion forces created between driven magnet 194 and drive magnet 196. As previously discussed, driven magnet 194 can be linked to nozzle cap 114 via connector shaft 134. Therefore, any movement of driven magnet 194 can actuate nozzle cap 114 and alter average flow direction 174.

In one embodiment, driven magnet 194 can be sealed by magnet cap 198 to seal and protect driven magnet 194 from the water passing through nozzle chamber 126.

Preferably, driven magnet 194 and drive magnet 196 are not mechanically connected to one another. In one embodiment, a gap 200 can exist between drive magnet 196 and driven magnet 194. This feature can be advantageous from a safety perspective. For this particular embodiment, if an individual steps on or touches nozzle cap 114 with his/her hand during actuation mode, that individual will not likely adopt the movement of nozzle cap 114 to his/her detriment. The force exerted by the individual will likely break the attractive magnetic force present between driven magnet 194 and drive magnet 196.

Drive magnet 196 can be coupled to nozzle cap driver 202. In one embodiment, drive magnet 196 can be mounted on nozzle cap driver 202. In one embodiment, nozzle cap driver 202 can comprise walls 204 for restraining the drive magnet 196 in a side-to-side and downward direction within nozzle cap driver 202, as illustrated in FIG. 3. As shown in FIGS. 3 and 14, drive magnet bearing 206 can contact the upper surface 208 of drive magnet 196 and can constrain the drive magnet 196 vertically within nozzle cap driver 202. Drive magnet bearing 206 can be coupled to the underside of enclosure top 230 and can facilitate the movement of drive magnet 196 and nozzle cap driver 202 relative to the underside of enclosure top 230. In some embodiments, drive magnet bearing 206 can be a thin piece of PTFE or low friction material.

Nozzle cap driver 202 can lie in a driver support plane 210 (FIGS. 3 and 14). Driver support plane 210 can intersect driver support surface 212 (FIG. 14). Driver support surface 212 can provide support for nozzle cap driver 202, against gravitational forces, for example. The embodiment illustrated in FIG. 14, comprises two support surfaces (212). The movement of nozzle cap driver 202 can be constrained to movement parallel to driver support plane 210.

In some embodiments, as shown in FIG. 3, central axis 214 can pass through central pivot point 168. In one embodiment of the invention, spherical bearing 138 can have a central pivot point 168. In some embodiments of the invention, central pivot point 168 can be located at the center of rotation of spherical bearing 138. The driver support plane 210 can be defined by the orthogonal intersection between central axis 214 and driver support plane 210. The intersection of central axis 214 and driver support plane 210 can define a driver plane center 216. The driver plane center 216 can act as a reference point of origin for describing the movement of nozzle cap driver 202 parallel to driver support plane 210. A person skilled in the art can appreciate that central axis 214 need not pass through central pivot point 168. Central axis 214 need not be at a particular location within articulated nozzle system 100, so long as it orthogonally intersects driver support plane 210 to define driver plane center 216. Central axis 214, driver support plane 210 and driver plane center 216 can remain fixed during movement of nozzle cap driver 202 to provide a point of origin reference point for indexing the movement of nozzle cap driver 202 within driver support plane 210. During movement of nozzle cap 114, fixed portion of nozzle cap support can remain stationary relative to driver plane center 216. That is, bearing housing 130 and outer bearing 150 can remain stationary relative to driver plane center 216.

Drive module 220 (FIG. 14) can change the location of nozzle cap driver 202 within driver support plane 210 (FIGS. 3 and 14), relative to driver plane center 216 (FIG. 3). As illustrated in FIG. 11*a*, the location of nozzle cap driver 202 along the driver support plane 210 can be defined by two components. The first component can be a radial displacement 222 representing a distance that nozzle cap driver is away from driver plane center 216. The second component can be an angular orientation 224, measured clockwise or counterclockwise from a reference line 226 that lies in the driver support plane 210. FIG. 11*a* illustrates the angular orientation 224 measured counterclockwise from reference line 226. As shown in FIG. 11*a*, nozzle cap driver 202 can have a position represented by radial displacement 222 and angular orientation 224. Nozzle cap driver 202 can be coupled to drive magnet 196 such that when nozzle cap driver 202 moves about driver support plane 210, drive magnet 196 has a corresponding radial displacement and a corresponding angular orientation to that of nozzle cap driver 202.

In one embodiment, due to the attractive forces between the drive magnet 196 and driven magnet 194 (FIG. 3), and the fact that the driven magnet 194 is movably mounted, the movement of driven magnet 194 can match, or at least substantially follow, the movement of drive magnet 196 within driver support plane 210 (FIG. 3).

As illustrated in FIG. 3, nozzle cap 114 can be linked to nozzle cap driver 202. In one embodiment, driven magnet 194 is linked to nozzle cap 114 via the connector shaft. In one embodiment, nozzle cap 114 can be coupled to driven magnet 194 by connector shaft 134, wherein first end 190 of connector shaft 134 comprises driven magnet 194. In a particular embodiment, driven magnet 194 is coupled to drive magnet 196 by attractive magnetic force such that driven magnet 194 substantially follows drive magnet 196. Therefore, movement of nozzle cap driver 202 can create a corresponding radial displacement and a corresponding angular orientation of drive magnet 196 (FIG. 3), driven magnet 194 (FIG. 3) and first end 190 of connector shaft 134 (FIG. 3) in planes parallel to driver support plane 210. Thus, the radial displacement 222 of nozzle cap driver 202 away from driver plane center 216 (FIG. 11*a*) can determine the elevation angle 176 of average flow direction 174 (FIG. 9). As shown in FIG. 12, increasing radial displacement 222 can decrease elevation angle 176. Conversely, decreasing radial displacement 222 can increase elevation angle 176. As shown in FIG. 13, the angular orientation 224 of nozzle cap driver 202 about driver plane center 216 can determine the angular orientation 184 of trajectory plane base component 180 of average flow direction 174. As also shown in FIG. 13, moving the angular orientation 224 of nozzle cap driver 202 in a counterclockwise direction can move the angular orientation 184 of trajectory plane base component 180 in a counterclockwise direction. In one embodiment of the invention, the angular orientation 184 can be angular orientation 224 minus approximately 180 degrees, as illustrated in FIG. 13.

FIG. 14 illustrates an exploded perspective view of drive module 220, for changing radial displacement 222 and angular orientation 224 of nozzle cap driver 202 (FIG. 11*a*), so as to change the elevation angle 176 (FIG. 9) and angular orientation 184 (FIG. 10) of average flow direction 174.

In the example embodiment illustrated in FIG. 14, drive module 220 can be completely enclosed by drive enclosure 228, which can be fixedly attached to the lower end of nozzle chamber housing 128 (FIG. 3). Drive enclosure 228 can include enclosure top 230 and enclosure bottom 232. Enclosure top 230 and enclosure bottom 232 can be fixedly connected to one another at gasket 234. Gasket 234 can provide a water-proof seal between enclosure top 230 and enclosure bottom 232. By having a separate, sealed-off drive enclosure 228, the components of drive module 220 can be advantageously isolated from the water flow path, and more specifically, the water passing through nozzle chamber 126 (FIG. 3). This isolation can protect the components of drive module 220 from water damage.

In the embodiment shown in FIG. 14, drive module 220 can include a first axis motor 236 and a second axis motor 238. In one embodiment, these motors can be step motors. Step motors convert electrical inputs into mechanical movement, and are known in the art. Electrical wires for activating the step motors (not shown) can be fed into drive enclosure 228 via cord seal 240.

In this particular embodiment, drive module 220 comprises a first axis driver 242 and a second axis driver 244.

First axis driver 242 can create movement of nozzle cap driver 202 in a direction parallel to the first axis direction, while second axis driver 244 can create movement of nozzle cap driver 202 in a direction parallel to the second axis. The first axis can be different, that is, non-parallel to the second axis. In a further embodiment of the invention, the first axis can be substantially orthogonal to the second axis.

First axis driver 242 can comprise first axis actuator assembly 246, coupled to first axis base 248. In one embodiment of the invention, first axis actuator assembly 246 comprises first axis pulleys (250), first axis belt 252 and first axis motor 236. In this embodiment, first axis belt 252 can be mechanically linked to pulleys (250). Pulleys (250) can be mechanically linked to first axis motor 236. As first axis motor 236 rotates, the first axis belt 252 can move in a path guided by the first axis pulleys (250). Movement of the first axis belt 252 between the pulleys (250) can be in a direction parallel to the first axis.

Second axis driver 244 can comprise second axis base 256 that can be coupled to first axis belt 252. In one embodiment of the invention, second axis base 256 can be fixedly attached to first axis belt 252. Second axis base 256 can be slidably coupled to first axis support surface (258). Apertures 260 of second axis base 256 can slide along the first axis support surface (258). Therefore, the slidably coupled connection between first axis base 248 and second axis base 256 can allow second axis base 256 to move in a direction parallel to the first axis direction when actuated by the movement of first axis actuator assembly 246. Bronze bushings, lubricant, or the like, can be used to facilitate the sliding motion of second axis base 256 along first axis support surface (258).

Second axis driver 244 can function in a similar manner to first axis driver 242. Second axis driver 244 can comprise second axis actuator assembly 262 comprising second axis pulleys (264), second axis motor 238, and second axis belt 266. Second axis motor 238 can move second axis belt 266 in a path guided by second axis pulleys (264). Movement of second axis belt 266 between the second axis pulleys (264) can be in a direction parallel to the second axis.

Nozzle cap driver 202 can be coupled to second axis belt 266. Apertures 268 of nozzle cap driver 202 can slide along driver support surface 212. In the embodiment illustrated in FIG. 14, driver support surface 212 comprises two rails. Driver support surface 212 can be within drive module 220, as part of second axis driver 244. Driver support surface 212 can allow nozzle cap driver 202 to slide relative to second axis base 256, in a direction parallel to the second axis. Bronze bushings, lubricant, or the like, can be used to facilitate the sliding motion of nozzle cap driver 202 along driver support surface (212).

Through the first axis and second axis pulley and belt systems, nozzle cap driver 202 can be moved along the driver support plane 210. As previously discussed, the location of nozzle cap driver 202 can be defined by a radial displacement 222 from driver plane center 216 and angular orientation 224 that rotates about driver plane center 216 (see FIG. 11*a*).

Referring to FIG. 14, when the first axis driver 242 moves second axis driver 244 in a first axis direction, nozzle cap driver 202 moves in a direction parallel to the first axis away from driver plane center 216 (FIGS. 3 and 11*a*). When second axis driver 244 moves nozzle cap driver 202 in a direction parallel to the second axis, nozzle cap driver 202 moves in a direction parallel to the second axis away from the driver plane center 216 (FIGS. 3 and 11*a*). The location of nozzle cap driver 202 on driver support plane 210 relative to driver plane center 216 can be represented by a first axis distance 270 in a direction parallel to the first axis, and a second axis distance 272 in a direction parallel to the second axis, as illustrated in FIG. 11*b*. Those skilled in the art can appreciate that the same location of nozzle cap driver 202 can also be represented by a polar coordinate system consisting of a radial displacement 222 and an angular orientation 224, to represent the location of nozzle cap driver 202 relative to driver plane center 216, as illustrated in FIG. 11*a*. Either reference system can be used to describe the location of nozzle cap driver 202 relative to driver plane center 216. Simple trigonometric relationships, as would be known by those skilled in the art, can be used to determine radial displacement 222 and angular orientation 224 (FIG. 11*a*) from the first axis distance 270 and second axis distance 272 (FIG. 11*b*), and vice versa.

In another embodiment, movement of nozzle cap driver 202 along the driver support plane 210 can be actuated by a rack and pinion gear assembly. In this particular embodiment, the rack and pinion gear assembly can be incorporated within drive enclosure 228 and replaces the pulley and belt assembly described above. That is, first axis actuator assembly 246 can comprise a first axis rack and pinion gear system to convert the rotary motion of first axis motor 236 to the linear movement of second axis driver 244 in a direction parallel to the first axis. Second axis actuator assembly 262 can comprise a second rack and pinion gear system to convert the rotary motion of a second axis motor 238 into linear movement of the nozzle cap driver 202 in a direction parallel to the second axis. The general use of a rack and pinion gear system to convert the rotary motion of a motor into linear movement is known in the art.

In another embodiment, movement of nozzle cap driver 202 along the driver support plane 210 can be actuated by a chain and sprocket assembly. In this particular embodiment, the chain and sprocket assembly can be incorporated within drive enclosure 228 and replaces the pulley and belt assembly described above. That is, first axis actuator assembly 246 can comprise a first axis chain and sprocket assembly to convert the rotary motion of first axis motor 236 to the linear movement of second axis driver 244 in a direction parallel to the first axis. Second axis actuator assembly 262 can comprise a second chain and sprocket assembly to convert the rotary motion of a second axis motor 238 into linear movement of the nozzle cap driver 202 in a direction parallel to the second axis. The general use of a chain and sprocket assembly to convert the rotary motion of a motor into linear movement is known in the art.

In another embodiment, servo motors can be used within drive enclosure 228 to actuate nozzle cap driver 202. Servo motors, used in conjunction with limit switches, can be used to index the position of nozzle cap driver 202. In another embodiment, servo motors and limit switches can be used to create a closed loop, sensory feedback system. The use of servo motors and limit switches to index planar movement is known in the art.

In another embodiment, at least one light source 274 can be fixedly placed in slab hanger 102 within light housing 276 (see FIG. 1). The at least one light source can comprise, but is not limited to, an LED light. In a particular embodiment, light sources (274) do not move with nozzle cap 114 and remain stationary during the movement of average flow direction 174 (FIG. 3). The light sources (274) can serve the purpose of illuminating and/or changing the color of exiting water 116.

FIG. 15*a* illustrates a perspective view of an alternative embodiment of the invention. Similar to the embodiment illustrated in FIG. 1, the ends of the example articulated nozzle system 100 illustrated in FIG. 15*a* can comprise slab hanger 102 and water inlet 104. For brevity, the description of FIG. 1 is not repeated relative to FIG. 15*a*. For clarity, the same reference numerals are used to designate like elements of the embodiments of FIGS. 1 and 15*a*.

FIG. 15*b* illustrates a side view of the articulated nozzle system 100 that is illustrated in FIG. 15*a*.

In FIG. 16, there is illustrated a top view of articulated nozzle system 100 that is illustrated in FIG. 15*a*, showing top surface 106 of slab hanger 102.

FIG. 17 shows a front view of the example articulated nozzle system 100 illustrated in FIG. 15*a*. FIG. 18 illustrates a side view of this example articulated nozzle system 100. As illustrated by FIGS. 15*b*, 17 and 18, slab hanger 102 can be placed within existing surface 108.

Referring back to FIG. 15*a*, the water supply entering articulated nozzle system 100 can enter the system though water inlet 104. In one embodiment, water inlet 104 can be an opening in intake pipe 110. Intake pipe 110 can convey water received by water inlet 104 to the remainder of articulated nozzle system 100. Alternatively, water inlet 104 can receive the water supply so that it is conveyed directly into the remainder of the articulated nozzle system 100. After entering water inlet 104, the water can then pass through articulated nozzle system 100 to be received by nozzle cap 114. The water can then exit nozzle cap 114. The water can exit nozzle cap 114 in the form of exiting water 116, which can be visible to the end user. To allow the water to pass through articulated nozzle system 100, water inlet 104 and nozzle cap 114 can be in fluid communication with one another.

In the embodiment shown in FIG. 15*a*, the articulated nozzle system 100 can be connected to intake pipe 110 by an approximately 90-degree pipe elbow (pipe elbow 112). However, intake pipe 110 can be connected to articulated nozzle system 100 in virtually any orientation.

As shown in FIG. 15*b*, in one embodiment of the invention, control valve 277, can be used to control the amount of water entering water inlet 104. Control valve 277 can open water inlet 104 to receive water or close water inlet 104 to block water, as is known in the art. Control valve 277 can also be partially opened to regulate pressure of water entering water inlet 104 and can consequently regulate the spray height of exiting water 116. The use of control valves to regulate flow and pressure is known in the art.

Once the water enters articulated nozzle system 100 at water inlet 104, the water can follow a water flow path. Water in the water flow path can move from the water inlet 104 to wye assembly 278.

The embodiment illustrated in FIG. 15*a* can be modified to comprise a flow control device 118, as illustrated in FIG. 19. In this particular embodiment, water can move from the water inlet 104 to wye assembly 278, via flow control device 118. A perspective view of articulated nozzle system 100 with flow control device 118 is illustrated in FIG. 19.

Flow control device 118 can operate in a similar fashion to flow control device 118 in the embodiment illustrated in FIG. 1 (as discussed above) to sequence the water projection of exiting water 116 seen by the end user.

Referring back to FIG. 15*a*, flow control device 118 can be omitted from articulated nozzle system 100. In this particular embodiment, water received by water inlet 104 can pass from water inlet 104 to wye assembly 278, without passing through a flow control device 118.

An example wye assembly 278 is illustrated in FIG. 20. Wye assembly 278 can be part of the water flow path. The embodiment illustrated in FIG. 20 comprises pipe elbow 112, and water can pass from water inlet 104, through pipe elbow 112, to wye assembly 278. In this particular embodiment, the water does not pass through flow control device 118 before entering wye assembly 278. However, in another embodiment of the invention, water can pass through pipe elbow 112, flow control device 118 and wye assembly 278, in series, as illustrated in FIG. 19.

Referring to FIG. 20, water entering wye assembly 278 can enter wye chamber 280 then be diverted from wye chamber 280 into at least one diversion pipe 282. A diversion pipe can transfer the water to manifold assembly 284. For example, the water from wye chamber 280 can be diverted into two diversion pipes connected to two manifold assemblies 284, as illustrated in FIG. 20. The manifold components 286 can be held in place relative to one another via cement, adhesive, or the like, as is commonly known in the art. First ends 290 of barbed adaptors 288 can be received by corresponding apertures 294 in manifold components 286 to form a manifold assembly 284. Each manifold assembly 284 can form a chamber for containing the water.

The water can then exit manifold assemblies 284 by passing through barbed adaptors 288. A supply hose 291 (FIG. 15*b*) can be fluidly coupled to each second end 296 of barbed adaptors 288. Each supply hose fluidly connects a barbed adaptor 288 to a nozzle housing aperture 298 (FIG. 15*b*), allowing the water to flow from at least one manifold assembly 284 to nozzle housing 300 (FIG. 15*b*). Each supply hose can by-pass drive module 220 (FIG. 15*b*), thereby isolating the drive module from the water flow path and protecting the components of drive module 220 from water damage or interference.

FIG. 21 provides an exploded view of the articulated nozzle system 100 illustrated in FIG. 15*a*. As shown in FIG. 21, nozzle cap 114 can cover open end 302 of nozzle housing 300. In some embodiments of the invention, nozzle cap 114 can comprise a flat member that extends across open end 302 of nozzle housing 300. In another embodiment of the invention, nozzle cap 114 can be shaped to extend into nozzle housing 300. Nozzle cap 114 can be coupled to nozzle housing 300 via flexible boot 145. In the embodiment shown in FIG. 21, the proximal portion 310 of flexible boot 145 can be clamped between ridge 304 of nozzle housing 300 and protrusion 306 of nozzle cap 114. Nozzle cap 114 can be fixedly coupled to nozzle housing 300, via flexible boot 145, such that movement of one of these three elements is substantially matched by corresponding movements of the other two elements.

FIG. 16 illustrates a top view of nozzle cap 114 and flexible boot 145 placed within slab hanger 102. As shown in FIG. 16, nozzle cap 114 can be surrounded by flexible boot 145. In one embodiment of the invention, nozzle cap 114 can lie in substantially the same horizontal plane as flexible boot 145 during non-actuation of nozzle cap 114.

As shown in FIG. 21, nozzle cap support can comprise flexible boot 145. Fixed portion of nozzle cap support can comprise distal portion 308 of flexible boot 145. Distal portion 308 can be coupled to lower surface 156 of slab hanger 102 via support ring 154. Distal portion 308 of flexible boot 145 can be fixedly clamped between lower surface 156 of slab hanger 102 and support ring 154, so that the distal portion 308 of flexible boot 145 can remain stationary during rotation of nozzle cap 114. That is, fixed portion of nozzle cap can remain stationary relative to slab hanger 102 and driver plane center 216. Support ring 154 can be coupled to lower surface 156 of slab hanger 102 by screws, nuts and bolts, adhesive material, or the like. When distal portion 308 of flexible boot 145 is fastened to the lower surface 156 of slab hanger 102, proximal portion 310 of flexible boot 145 can remain free to move relative to slab hanger 102 and driver plane center 216. The flexibility of proximal portion 310 of flexible boot 145 can allow for rotation of nozzle cap 114.

As water pressure builds within nozzle housing 300, the water can enter nozzle cap 114 via at least one nozzle entrance aperture 312. The water can then exit nozzle cap 114 via at least one exit aperture 140. In an embodiment wherein the nozzle cap 114 comprises a flat member, nozzle entrance aperture 312 can also serve as an exit aperture 140.

As illustrated in FIGS. 17 and 18, a notional stationary nozzle cap base plane 166 can intersect central pivot point 168. Nozzle cap support can comprise flexible boot 145, wherein flexible boot 145 can provide central pivot point 168. In one embodiment of the invention, central pivot point 168 can be located at the central point about which proximal portion 310 of flexible boot 145 (FIGS. 16 and 21) can rotate. In one embodiment, central pivot point 168 can be located at the center of gravity of flexible boot 145. Each exiting stream (142) exiting an exit aperture (140) can have a stream flow direction 172, which represents the direction of water travel exiting from nozzle cap 114, away from the nozzle cap base plane 166. The exiting water 116 can have an average flow direction 174. The average flow direction 174 can be the average of the stream flow directions (172).

The average flow direction 174 can be measured relative to nozzle cap base plane 166. Average flow direction 174 can be defined by two variable angles, both angles being measured relative to nozzle cap base plane 166.

FIG. 22 provides a simplified side view of the nozzle cap 114 and central pivot point 168. The first angle can be an elevation angle 176, as illustrated in FIG. 22. Elevation angle 176 represents the angle between average flow direction 174 and nozzle cap base plane 166, as discussed above (with reference to FIGS. 9 and 10).

FIG. 23 provides a top view of the simplified components in FIG. 22. The second angle can be angular orientation 184, as illustrated in FIG. 23. Angular orientation 184 can be represented by the angle between trajectory plane base component 180 and reference line 182, as previously discussed.

In a particular embodiment, the elevation angle 176 of average flow direction 174 (FIG. 22) can be limited to a range of 75 to 90 degrees, measured between average flow direction 174 and nozzle cap base plane 166. In a further embodiment of the invention, angular orientation 184 (FIG. 23) can move between 0 to 360 degrees.

Referring back to FIG. 21, a second end 192 of connector shaft 134 can be coupled to nozzle cap 114. This coupling can allow movement of second end 192 of connector shaft 134 to move nozzle cap 114. In one embodiment, nozzle cap 114 can be fixedly connected to second end 192 of connector shaft 134 by a nut and bolt assembly, the use of an adhesive material, or the like. In one embodiment, connector shaft 134 can pass through nozzle housing 300 to connect with nozzle cap 114. As discussed above, nozzle cap 114 can be coupled to flexible boot 145 and nozzle housing 300. Thus, movement of second end 192 of connector shaft 134 can also move flexible boot 145, and nozzle housing 300.

In one embodiment, each supply hose 291 (FIG. 15*b*) can be made of corrugated and/or flexible material such that any movement of nozzle housing 300 is relatively unconstrained. In another alternative embodiment, each supply hose 291 can be long enough such that any movement of nozzle housing 300 is unlikely to be constrained by any supply hose.

As previously discussed and shown in FIG. 21, flexible boot 145 can provide central pivot point 168. In some embodiments, central pivot point 168 can be located at the center of rotation of proximal portion 310 of flexible boot 145 (FIGS. 16 and 21). As first end 190 of connector shaft 134 is moved, connector shaft 134 can rotate about central pivot point 168. Due to the coupled connection between second end 192 of connector shaft 134 and nozzle cap 114, movement of first end 190 can also move nozzle cap 114. That is, changing the radial displacement 222 and angular orientation 224 of nozzle cap driver 202 along driver support plane 210 (FIG. 11*a*) can create a corresponding change in a radial displacement and an angular orientation of first end 190 of connector shaft 134 along driver support plane 210 (FIG. 21). Movement of first end 190 can then create a corresponding change in the rotation of nozzle cap 114 about central pivot point 168 (FIG. 21). Through this movement sequence, nozzle cap 114 can be moved so as to vary elevation angle 176 (FIG. 22) and angular orientation 184 (FIG. 23) of average flow direction 174. Therefore, movement of first end 190 of connector shaft 134 (FIG. 21) can vary the average flow direction 174 of exiting water 116, as seen by the end user (FIGS. 17 and 18).

Referring to FIG. 21, first end 190 of connector shaft 134 can be mechanically attached to nozzle cap driver 202. In one embodiment, nozzle cap 114 can be mechanically attached to nozzle cap driver 202, via connector shaft 134 and swivel bearing 314. Swivel bearing 314 can comprise an outer bearing 316 that is fixedly attached to nozzle cap driver 202 via bearing hold-down 318. Bearing hold-down 318 can clip into nozzle cap driver aperture 320 so as to fixedly couple outer bearing 316 to nozzle cap driver 202. Swivel bearing 314 can also comprise an inner bearing 322. Inner bearing 322 can rotate relative to outer bearing 316 and can be fixed to first end 190 of connector shaft 134. A person skilled in the art can appreciate that without swivel bearing 314, the connection between first end 190 of connector shaft 134 and nozzle cap driver 202 could become disengaged or damaged during movement of nozzle cap driver 202. Alternatively, a completely fixed connection between first end 190 of connector shaft 134 and nozzle cap driver 202 could preclude the movement of nozzle cap driver 202. Swivel bearing 314 can comprise a spherical bearing or other similar bearing known in the art.

Nozzle cap driver 202 can lie in a driver support plane 210. Driver support plane 210 can intersect driver support surface 212. In the embodiment illustrated in FIG. 21, driver support surface 212 comprises the upper surfaces of rails. The movement of nozzle cap driver 202 can be constrained to movement parallel to the driver support plane 210.

In one embodiment of the invention, central axis 214 can pass through central pivot point 168. Nozzle cap support can comprise flexible boot 145. Proximal portion 310 of flexible boot 145 can comprise central pivot point 168. In a particular embodiment of the invention, central pivot point 168 can be located at the center of rotation of proximal portion 310 of flexible boot 145. Driver support plane 210 can be defined by its orthogonal intersection with central axis 214. The intersection point of central axis 214 and driver support plane 210 can define a driver plane center 216 (FIGS. 17 and 18). The driver plane center 216 can act as a reference point of origin for describing the movement of nozzle cap driver 202, within driver support plane 210. A person skilled in the art can appreciate that central axis 214 need not pass through central pivot point 168. Central axis 214 need not be at a particular location within articulated nozzle system 100, so long as it orthogonally intersects driver support plane 210 to define driver plane center 216. Central axis 214, driver support plane 210 and driver plane center 216 can remain fixed during movement of nozzle cap driver 202, such that driver plane center 216 can provide a point of origin reference point for indexing the movement of nozzle cap driver 202 within driver support plane 210.

During movement of nozzle cap 114, fixed portion of nozzle cap support can remain stationary. That is, during movement of nozzle cap driver 202 and nozzle cap 114, distal portion 308 of flexible boot 145 can remain stationary relative to driver plane center 216.

Drive module 220 (FIG. 15*b*) can change the location of nozzle cap driver 202 within driver support plane 210, relative to driver plane center 216. As illustrated in FIG. 11*a*, the location of nozzle cap driver 202 along driver support plane 210 can be defined by two components. The first component can be radial displacement 222, representing a distance that nozzle cap driver is away from driver plane center 216. The second component can be angular orientation 224, measured clockwise or counterclockwise from a reference line 226 that lies in the driver support plane 210. FIG. 11*a* illustrates the angular orientation 224 measured counterclockwise from reference line 226.

In one embodiment, due to the mechanical coupling between first end 190 of connector shaft 134 (FIG. 21) and nozzle cap driver 202 (FIG. 21), the movement of first end 190 within a plane parallel to the driver support plane can substantially match, or at least follow, the movement of nozzle cap driver 202 within driver support plane 210.

As discussed above, nozzle cap 114 can be linked to nozzle cap driver 202. In one embodiment, nozzle cap 114 is linked to nozzle cap driver 202 via connector shaft 134 (FIG. 21). Therefore, as shown in FIG. 12, the radial displacement 222 of nozzle cap driver 202 away from driver plane center 216 (FIG. 11*a*) determines the elevation angle 176 of average flow direction 174 (FIG. 22). As shown in FIG. 12, increasing radial displacement 222 can decrease elevation angle 176. Conversely, decreasing radial displacement 222 can increase elevation angle 176. The angular orientation 224 of nozzle cap driver 202 about driver plane center 216 (FIG. 11*a*) can determine the angular orientation 184 of trajectory plane base component 180 (FIG. 23). As shown in FIG. 13, changing the angular orientation 224 of nozzle cap driver 202 in a counterclockwise direction, can move the angular orientation 184 of trajectory plane base component 180 in a counterclockwise direction. In one embodiment of the invention, angular orientation 184 can be angular orientation 224 minus approximately 180 degrees, as illustrated in FIG. 13.

FIG. 24*a* provides a perspective view of some of the components of the articulated nozzle system 100 illustrated in FIG. 15*a*. FIG. 24*a* includes a perspective view of drive module 220. Drive module 220 can change radial displacement 222 and angular orientation 224 of nozzle cap driver 202 (FIG. 11*a*).

As illustrated in FIG. 24*a*, drive module 220 can comprise a first axis driver 242 and a second axis driver 244. First axis driver 242 can create movement of nozzle cap driver 202 in a direction parallel to the first axis, while second axis driver 244 can create movement of nozzle cap driver 202 in a direction parallel to the second axis. The first axis can be different, that is, non-parallel with the second axis. In a further embodiment of the invention, the first axis can be substantially orthogonal to the second axis.

As illustrated in FIGS. 17 and 18, for example, in an embodiment of the invention, first axis driver 242 can be fixedly attached to slab hanger 102 by at least one hanger rod 324. At least one hanger rod 324 can be fixedly attached to the lower surface 156 of slab hanger 102. Each hanger rod 324 can also be fixedly connected to first axis base 248 (FIG. 24*a*), via bracket 326. The slab hanger 102, hanger rod 324, bracket 326 and first axis base 248 can be coupled together via a nut and bolt assembly, for example. In addition to the nut and bolt assembly outlined above, a person skilled in the art would appreciate that other fixation methods that are known in the art could be used to fixedly couple slab hanger 102, hanger rod 324, bracket 326 and first axis base 248 (FIG. 24*a*) to one another. Through the fixed coupling of slab hanger 102 to first axis base 248, first axis driver 242 (FIG. 24*a*) can remain stationary relative to slab hanger 102.

Referring to FIG. 21, first axis driver 242 can comprise a first axis base 248. First axis base 248 can comprise a first axis support surface 258. First axis driver 242 can also comprise a first axis carriage 328, which can be slidably coupled to first axis support surface 258. In one embodiment, first axis carriage 328 comprises at least one first axis carriage roller 330 that can roll along first axis support surface 258.

In the embodiment illustrated in FIG. 21, first axis support surface 258 can comprise two first axis support surfaces (258) oriented in a first axis direction. In this embodiment, the two first axis support surfaces (258) can each comprise a groove for slidably engaging first axis carriage rollers (330). In this particular embodiment, two rollers can slide along each first axis support surface 258, within each groove, in a direction parallel to the first axis. Since first axis carriage rollers (330) are coupled to first axis carriage 328, the first axis carriage can slide relative to first axis support surfaces (258), in a direction parallel to the first axis. In this particular embodiment, two first axis support surfaces (258) can be covered by support surface covers (331) that can removably clip into first axis base 248 by the mating of clips (332) and clip apertures (334). Support surface covers 331 can be placed above a first axis carriage roller 330 to ensure that a first axis carriage roller 330 does not move off of a support surface 258.

In an alternative embodiment of the invention, first axis support surface 258 can simply be a planar surface with no particular orientation that allows for movement of first axis carriage 328 relative to first axis base 248 in a direction parallel to the first axis.

The movement of first axis carriage 328 relative to first axis base 248 can be actuated by a first axis actuator assembly 246. In one embodiment of the invention, first axis actuator assembly 246 comprises at least one first axis pneumatic cylinder 338*a* (FIG. 24*b*). For the actuation assembly illustrated in FIG. 24*b*, first axis actuator assembly 246 comprises two first axis pneumatic cylinders (338*a*), each oriented parallel to the first axis. In this particular embodiment, each first axis pneumatic cylinder 338*a* comprises a first end 340*a*, a second end 342*a*, and a variable pneumatic cylinder length 344*a* measured between first end 340*a* and second end 342*a*.

FIG. 24*a* includes a partial cut-away view of first axis driver 242. First axis base 248 can comprise at least one travel limiting protrusion 336*a*. As part of the actuation of first axis carriage 328, travel limiting protrusion 336*a* can come into contact with second end 342*a* of first axis pneumatic cylinder 338*a* (FIG. 24*b*).

As shown in the bottom view illustrated in FIG. 24*b*, a first axis pneumatic cylinder 338*a* can have an outer cylinder 346*a* surrounding inner shaft 348*a*. Outer cylinder 346*a* can comprise first end 340*a*, and inner shaft can comprise second end 342*a*. Air pressure can enter first end 340*a* of first axis pneumatic cylinder 338*a* via air tube 350*a*. When air pressure enters first axis pneumatic cylinder 338*a*, inner shaft 348*a* can move relative to outer cylinder 346*a* in a direction parallel to the first axis. As air pressure initially enters first axis pneumatic cylinder 338*a*, inner shaft 348*a* can move away from outer cylinder 346*a*. Initially, outer cylinder 346*a* remains stationary as second end 342*a* of inner shaft 348*a* moves away from outer cylinder 346*a*. Therefore, the air flow from air tube 350*a* into first end 340*a* can push second end 342*a* away from outer cylinder 346*a*, thereby increasing pneumatic cylinder length 344*a*. Pneumatic cylinder length 344*a* can increase to the point that second end 342*a* of inner shaft 348*a* contacts travel limiting protrusion 336*a*. Once second end 342*a* of inner shaft 348*a* contacts travel limiting protrusion 336*a*, second end 342*a* remains stationary, as it cannot move any further in a direction parallel to the first axis because it is constrained by travel limiting protrusion 336*a*. When second end 342*a* is constrained, the air flow from air tube 350*a* can continue to increase the pressure within first axis pneumatic cylinder 338*a*, thereby increasing pneumatic cylinder length 344*a*. However, this further increase in pneumatic cylinder length 344*a* can now be caused by outer cylinder 346*a* moving away from second end 342*a*, since second end 342*a* is stationary at this point in the actuation process. Therefore, outer cylinder 346*a* can then move in a direction that is parallel to the first axis, and is substantially opposite to the initial direction traveled by second end 342*a*. Since outer cylinder 346*a* can be coupled to first axis carriage 328, it can push first axis carriage 328 in a direction parallel to the first axis. Therefore, the movement of first axis carriage 328 can be substantially opposite to the direction of airflow from air tube 350*a* into first end 340*a* of first axis pneumatic cylinder 338*a*.

First axis pneumatic cylinder 338*a* can comprise a pneumatic cylinder spring (not shown) within outer cylinder 346*a*, coupling outer cylinder 346*a* to inner shaft 348*a*. During actuation, as pneumatic cylinder length 344*a* increases, a resistive biasing force is generated by the pneumatic cylinder spring. During actuation, air pressure supplied by air tube 350*a* overcomes the biasing force and extends pneumatic cylinder length 344*a*. Once the air pressure is removed from first axis pneumatic cylinder 338*a*, the biasing force generated by the pneumatic cylinder spring can return first axis pneumatic cylinder 338*a* to its initial pneumatic cylinder length 344*a*.

As illustrated in FIG. 24*b*, two first axis pneumatic cylinders (338*a*) can be oriented parallel to the first axis, but at 180 degrees relative to one another. Therefore, actuating one first axis pneumatic cylinder 338*a* can push first axis carriage 328 in a direction parallel to the first axis. Actuation of the other first axis pneumatic cylinder 338*a* can push first axis carriage 328 in a substantially opposite direction, which is still parallel to the first axis.

Travel limiting protrusion 336*a* can also serve to limit the movement of first axis carriage 328 relative to first axis base 248 (FIG. 24*a*). In the embodiment comprising two first axis pneumatic cylinders (338*a*), in one possible scenario, only one first axis pneumatic cylinder (338*a*) is activated. When one of the first axis cylinders is actuated, the second end 342*a* of the non-actuated first axis cylinder can be moved closer to travel limiting protrusion 336*a*. Once second end 342*a* of the non-actuated first axis pneumatic cylinder 338*a* contacts travel limiting protrusion 336*a*, movement of first axis carriage 328 is stopped. Therefore, travel limiting protrusion 336*a* can also limit excessive movement of first axis carriage 328 relative to first axis base 248, in a direction parallel to the first axis.

In one embodiment, second end 342*a* (FIGS. 24*a* and 24*b*) can comprise a domed nut that can be threaded onto inner shaft 348*a* of first axis pneumatic cylinder 338*a*. By adjusting the position of the domed nut relative to the threads on inner shaft 348*a*, this arrangement can be used to adjust pneumatic cylinder length 344*a*. By adjusting pneumatic cylinder length 344*a* in this manner, the range of movement of first axis carriage 328 relative to first axis base 248 can be adjusted. For example, shortening pneumatic cylinder length 344*a* in this manner increases the range of motion of first axis carriage 328, while extending pneumatic cylinder length in this manner decreases the range of motion of first axis carriage 328.

Referring to FIG. 24*a*, second axis driver 244 can be coupled to first axis carriage 328. In one embodiment, this coupling can be fixed and can be achieved by adhesive material, a nut and bolt assembly, or the like. In the illustrated embodiment of FIG. 24*a*, second axis base 256 of second axis driver 244 is fixedly attached to the top surface of first axis carriage 328. Therefore, movement of the first axis carriage 328 in a direction parallel to the first axis can move second axis base 256 in a corresponding direction parallel to the first axis.

Second axis driver 244 can function in a similar manner to first axis driver 242. Second axis driver 244 can comprise a second axis base 256. Second axis base 256 can comprise a driver support surface 212 that can be similar in structure and operation to first axis support surface 258. Second axis driver 244 can also move nozzle cap driver 202 in a direction parallel to the second axis. Nozzle cap driver 202 can be slidably coupled to driver support surface 212. At least one second axis pneumatic cylinder 338*b* (FIG. 24*b*) can be used to move nozzle cap driver 202 in a direction parallel to the second axis. A second axis pneumatic cylinder 338*b* operates in the same manner as a first axis pneumatic cylinder 338*a* (FIG. 24*b*), as described above. Referring to FIG. 24*b*, second axis pneumatic cylinder 338*b* can comprise a first end (not shown) and second end 342*b* that can be similar in structure and operation to first end 340*a* and second end 342*a* of first axis pneumatic cylinder 338*a*. Second axis pneumatic cylinder 338*b* can also comprise outer cylinder 346*b* and inner shaft 348*b*, which can be similar in structure and operation to outer cylinder 346*a* and inner shaft 348*b* of first axis pneumatic cylinder 338*a*. Furthermore, the pneumatic cylinder length (not shown) of second axis pneumatic cylinder 338*b* can vary in a similar manner to pneumatic cylinder length 344*a* of first axis pneumatic cylinder 338*a*. Second axis driver 244 can comprise at least one travel limiting protrusion (not shown) that is similar in structure and operation to travel limiting protrusion 336*a* of first axis driver 242 (FIG. 24*a*). In addition, air tube 350*b* of second pneumatic cylinder 338*b* can provide air pressure to the second pneumatic cylinder in a similar manner to the operation of air tube 350*a*. However, second axis pneumatic cylinder 338*b* can move nozzle cap driver 202 (FIG. 24*a*) in a direction parallel to the second axis.

FIG. 25 illustrates a perspective view of nozzle cap driver 202. Nozzle cap driver 202 can be slidably coupled to driver support surface 212 (FIGS. 21 and 24*a*) via at least one nozzle cap driver roller 351. The nozzle cap driver 202 can move relative to driver support surface 212 (FIGS. 21 and 24*a*) and second axis base 256 (FIG. 24*a*), in a manner similar to that outlined above for the movement of first axis carriage 328 relative to first axis support surface 258 (FIG. 24*a*). However, second axis driver 244 (FIG. 24*a*) moves nozzle cap driver 202 in a direction parallel to the second axis, as opposed to in a direction parallel to the first axis.

The actuation of the at least one first axis pneumatic cylinder 338*a* (FIG. 24*b*) and at least one second axis pneumatic cylinder 338*b* (FIG. 24*b*) can be controlled by a solenoid assembly 354 (FIG. 26). For the embodiment illustrated in FIG. 15*a*, solenoid assembly 354 can be coupled to wye assembly 278 (FIG. 15*b*).

FIG. 26 illustrates a perspective view of solenoid assembly 354. Air pressure can be provided to solenoid assembly 354 via air inlet 356. Air pressure can then pass through solenoid valve 358 (if that particular solenoid is energized) to first end 340*a* or 340*b* of a pneumatic cylinder 338*a* or 338*b* via air tube 350*a* or 350*b*, respectively (FIG. 24*b*). If a solenoid valve 358 is not energized, the solenoid valve can be in an exhaust position, wherein additional air pressure is not sent to first end 340*a* or 340*b* of a pneumatic cylinder (338*a* or 338*b*). When solenoid valve 358 is in the exhaust position, air pressure within a pneumatic cylinder (338*a* or 338*b*) can travel from a first end (340*a* or 340*b*), back through an air tube (350*a* or 350*b*), then back through solenoid valve 358. After passing back through solenoid valve 358, air pressure can then be released into the atmosphere via exhaust outlet 360. When solenoid valve 358 is energized, air pressure can travel through the solenoid valve 358 to actuate a pneumatic cylinder (338*a* or 338*b*). When solenoid valve 358 is in the exhaust position, air pressure can be vented from a pneumatic cylinder (338*a* or 338*b*) to return the pneumatic cylinder to a non-actuated position. Each solenoid valve is connected to a first axis pneumatic cylinder 338*a* or a second axis pneumatic cylinder 338*b*, via air tubes 350*a* or 350*b*, respectively. Air tubes (350*a* or 350*b*) can enter drive module 220 via base apertures 362 (FIGS. 15*b* and 24*a*).

In one embodiment of the invention, the four solenoid valves illustrated in FIG. 26 correspond to the four pneumatic cylinders (338*a* or 338*b*) illustrated in FIG. 24*b*. That is, each solenoid valve (358) can be fluidly connected to one of the four pneumatic cylinders (338*a* or 338*b*) via air tube 350*a* or 350*b*, respectively. When solenoid valve 358 is in the energized position, the pneumatic cylinder (338*a* or 338*b*) to which it is coupled can be actuated by air pressure to create movement in a direction parallel to the first axis or the second axis. The solenoid assembly 354 can operate to actuate one of the pneumatic cylinders, all of the pneumatic cylinders, or some combination inbetween, at a single moment in time.

The air supply provided to a pneumatic cylinder (338*a* or 338*b*) can be relatively low. In one embodiment, the force exerted by the pneumatic cylinders can be just enough to cause movement. For this particular embodiment, if an individual steps on or touches nozzle cap 114 (FIG. 15*a*) with his/her hand during actuation mode, that individual will not likely adopt the movement of nozzle cap 114 to his/her detriment. The force exerted by the individual will likely overcome the force exerted by the pneumatic cylinders.

As shown in FIG. 26, electrical cable 364 can provide the electrical signal to solenoid assembly 354 to sequence the activation and deactivation of the solenoid valves. The electrical signals can be provided to solenoid assembly 354 by a computer system (not shown) that is coupled to solenoid assembly 354 via electrical cable 364.

Referring to FIG. 21, through the operation of drive module 220, nozzle cap driver 202 can be moved anywhere along the driver support plane 210. As previously discussed, the location of nozzle cap driver 202 can be defined by a radial displacement 222 from driver plane center 216 and angular orientation 224 that rotates about driver plane center 216 (see FIG. 11*a*).

As illustrated in FIG. 11*b*, when the first axis driver 242 moves second axis driver 244 in a first axis direction, nozzle cap driver 202 moves a first axis distance 270 away from driver plane center 216. When second axis driver 244 moves nozzle cap driver 202 a direction parallel to the second axis direction, nozzle cap driver 202 moves in a second axis distance 272 away from the driver plane center 216. The distance of nozzle cap driver 202 from driver plane center 216 in the first axis direction and the second-axis direction can define the location of nozzle cap driver 202 within driver support plane 210, as illustrated in FIG. 11*b*. Those skilled in the art can appreciate that the same location of nozzle cap driver 202 can also be represented by a polar coordinate system consisting of a radial displacement 222 and an angular orientation 224, to represent the location of nozzle cap driver 202 relative to driver plane center 216, as illustrated in FIG. 11*a*.

In another embodiment, movement of nozzle cap driver 202 along the driver support plane 210 can be actuated by hydraulic cylinders. The drive module 220 comprising hydraulic cylinders could be similar in structure and operation to the embodiment comprising pneumatic cylinders outlined above. Unlike pneumatic cylinders, which can use air pressure to create actuated movement, hydraulic cylinders can use liquid pressure to move nozzle cap driver 202 along driver support plane 210.

In another embodiment, movement of nozzle cap driver 202 along the driver support plane 210 can be actuated by linear motors. In this particular embodiment, the linear motors can be incorporated into drive module 220 to replace the pneumatic cylinder actuators described above. That is, first axis actuator assembly 246 can comprise at least one first linear motor to move second axis driver 244 in the first axis direction. Second axis actuator assembly 262 can comprise at least one second linear motor to move nozzle cap driver 202 in a direction parallel to the second axis. The general use of linear motors to create linear movement within a plane is known in the art. In a particular embodiment of the invention, first and/or second linear motors can comprise a ball screw motor. In a further embodiment of the invention, first and/or second linear motors can comprise a worm gear motor.

In another embodiment, at least one light source (not shown) can be incorporated into the embodiment illustrated in FIG. 15*a*. The light source can be, but is not limited to an LED light. The at least one light source can be fixedly coupled to slab hanger 102. In one particular embodiment, the light sources do not move with nozzle cap 114 and remain stationary during the movement of average flow direction 174. The light sources can serve the purpose of illuminating and/or changing the color of exiting water 116.

FIG. 27*a* illustrates a perspective view of an alternative embodiment of the invention. Similar to the embodiments illustrated in FIGS. 1 and 15*a*, the ends of the example articulated nozzle system 100 illustrated in FIG. 27*a* can comprise slab hanger 102 and water inlet 104. For brevity, the descriptions of FIGS. 1 and 15*a* are not repeated relative to FIG. 27*a*. For clarity, the same reference numerals are used to designate like elements of the embodiments of FIGS. 1, 15*a*, and 27*a*.

FIG. 27*b* illustrates a side view of the articulated nozzle system 100 FIG. 27*a*.

FIG. 28 shows a top view of articulated nozzle system 100 of FIG. 27*a*, showing top surface 106 of slab hanger 102.

FIG. 29 shows a front view of the articulated nozzle system 100 of FIG. 27*a*. As illustrated in FIGS. 27*b* and 29, slab hanger 102 can be placed within existing surface 108.

Referring back to FIG. 27*a*, the water supply entering articulated nozzle system 100 can enter the system though water inlet 104. In one embodiment, water inlet 104 can be an opening in intake pipe 110. Intake pipe 110 can convey water received by water inlet 104 to the remainder of articulated nozzle system 100. Alternatively, water inlet 104 can receive the water supply so that it is conveyed directly into the remainder of the articulated nozzle system 100. After entering water inlet 104, the water can then pass through articulated nozzle system 100 to be received by nozzle cap 114. The water can then exit nozzle cap 114. The water can exit nozzle cap 114 in the form of exiting water 116, which can be visible to viewers. To allow the water to pass through articulated nozzle system 100, water inlet 104 and nozzle cap 114 can be in fluid communication with one another.

In the embodiment shown in FIG. 27*a*, the articulated nozzle system 100 can be connected to intake pipe 110 by an approximately 90-degree pipe elbow (pipe elbow 112). However, intake pipe 110 can be connected to articulated nozzle system 100 in different orientations.

In one embodiment of the invention, a control valve (not shown), used to control the amount of water entering water inlet 104, can be incorporated into the articulated nozzle system 100 of FIG. 27*a* in substantially the same way in which control valve 277 is incorporated into the articulated nozzle system 100 of FIG. 15*b*. The control valve can open water inlet 104 to receive water or close water inlet 104 to block water. The control valve can also be partially opened to regulate pressure of water entering water inlet 104 and can consequently regulate the spray height of exiting water 116.

Once the water enters articulated nozzle system 100 at water inlet 104, the water can follow a water flow path. Water in the water flow path can move from the water inlet 104 to wye assembly 279.

The embodiment illustrated in FIG. 27*a* can be modified to comprise a flow control device (not shown) similar to flow control device 118 in the embodiment illustrated in FIG. 19. In this particular embodiment, water can move from the water inlet 104 to wye assembly 279, via a flow control device 118 such as the flow control device of FIG. 19.

A flow control device can operate in a similar fashion to flow control device 118 in the embodiments illustrated in FIGS. 1 and 15*a* (as discussed above) to sequence the water projection of exiting water 116 seen by viewers.

Referring back to FIG. 27*a*, a flow control device can be omitted from articulated nozzle system 100. In this particular embodiment, water received by water inlet 104 can pass from water inlet 104 to wye assembly 279, without passing through a flow control device.

An example wye assembly 279 is illustrated in FIGS. 30*a* and 30*b*. Wye assembly 279 can be part of the water flow path. In the embodiment illustrated in FIGS. 30*a* and 30*b*, water can pass from water inlet 104, to wye assembly 279. In this particular embodiment, the water does not pass through a flow control device before entering wye assembly 279. However, in another embodiment of the invention, water can pass from water inlet 104, through a flow control device, and wye assembly 279, in series.

The wye assembly 279 illustrated in FIGS. 30*a* and 30*b* is an alternate, more integrated wye assembly 279 than wye assembly 278 illustrated in FIG. 15*a*. Wye assembly 279 can be a three-piece assembly comprising a base component 279*a*, a mating upper component 279*b*, and a wye assembly inlet pipe 113. The construction of wye assembly components 279*a* and 279*b* makes it such that a separate manifold assembly 284 (as illustrated in FIG. 20) is not required to divide the water flow into multiple streams. Instead, base component 279*a* and upper component 279*b* can be held in place relative to one another via cement, adhesive, or the like, to define a smooth continuous water flow path. For example, water can enter wye assembly 279 at inlet pipe 113, be divided appropriately and flow according to the contours of the base 279*a* and upper components 279*b* of wye assembly 279, and exit wye assembly 279 at the second ends 296 of barbed adapters 288. First ends 290 (best illustrated in FIG. 20) of barbed adaptors 288 can be received by corresponding apertures 294 formed as a result of the upper component 279*b* of wye assembly 279 mating with the base component 279*a* of wye assembly 279. Wye assembly 279 offers an alternative to wye assembly 278 (FIG. 20), using less parts and thereby reducing cost.

As illustrated in FIGS. 30*a* and 30*b*, a structural component 281, which may be in the shape of a cross, may be incorporated into the construction of upper component 279*b* of wye assembly 279 in order to provide additional rigidity to wye assembly 279, when assembled. Structural component 281 may also serve to mate with bracket 326 (FIG. 27*a*), for example, by passing fasteners through apertures in bracket 326 and mating them with threaded insert attachments 285 located within structural component 281.

Water can exit wye assembly 279 by passing though at least one barbed adaptor 288. A supply hose 291 (FIG. 27*b*) can be fluidly coupled to the second end 296 of each barbed adaptor 288. Each supply hose can fluidly connect a barbed adaptor 288 to a nozzle housing aperture 298 (FIG. 27*b*), allowing the water to flow from at least one barbed adapter 288 to nozzle housing 300 (FIG. 27*b*). Much like in the embodiment illustrated in FIG. 15, each supply hose of the embodiment of FIG.

27 can by-pass drive module 220 (FIG. 27*b*), thereby isolating the drive module from the water flow path and protecting the components of drive module 220 from water damage or interference.

FIG. 31 illustrates a perspective view of the articulated nozzle system 100 of FIG. 27*a* with a particular focus on flexible boot 145, nozzle cap 114, and boot clamp 287, which are exploded within the figure. In this embodiment, flexible boot 145 can be clamped between nozzle cap 114 and nozzle housing 300 (FIG. 27*b*) at the boot's 145 proximal portion 310.

Flexible boot 145 can be clamped between boot clamp 287 and intermediate surface 139 of slab hanger 102 at the flexible boot's distal portion 308. Boot clamp 287 can be coupled to intermediate surface 139 of slab hanger 102 using fasteners 289. Each fastener 289 can, but need not, be a threaded rod.

As shown in FIG. 31, nozzle cap 114 can be coupled to connector shaft 134, by connecting rods 188. In one embodiment of the invention, nozzle cap 114 can be fixedly coupled to connector shaft 134, via at least one connecting rod 188. The at least one connecting rod 188 can be, but need not be, a threaded rod. Therefore, in this embodiment, any movement of connector shaft 134 can move nozzle cap 114.

This particular embodiment allows the flexible boot 145 to be easily removed by simply detaching boot clamp 287 and nozzle cap 114, without having to displace the entire articulated nozzle system 100. As the flexible boot 145 may require frequent maintenance, it can be desirable to be able to remove it without disturbing the majority of the components of the articulated nozzle system 100.

In the embodiment illustrated in FIG. 27*a*, two light sources 274 can be fixedly placed in slab hanger 102 within light housings 276. Each of the two light sources can comprise an LED light. In a particular embodiment, light sources 274 do not move with nozzle cap 114, but instead remain stationary during the movement of average flow direction 174 (FIG. 29). The light sources 274 can serve the purpose of illuminating and/or changing the color of exiting water 116.

Other variations and modifications of the invention are possible. All such modifications and variations are believed to be within the sphere and scope of the invention as defined by the claims appended hereto.

The invention claimed is:

1. An articulated nozzle system, comprising:

a) a water inlet for receiving water from a water supply;

b) a nozzle cap for receiving the water from the water supply via the water inlet, and for directing the water exiting the nozzle cap, the water exiting the nozzle cap having an average flow direction away from a nozzle cap base plane, the nozzle cap being in fluid communication with the water inlet;

c) a nozzle cap driver for orienting the nozzle cap about a central pivot point to adjustably define the average flow direction, the nozzle cap driver being linked to the nozzle cap;

d) a driver support surface for supporting the nozzle cap driver in a driver support plane, wherein the driver support plane is defined by a central axis normal to the driver support plane, the intersection of the central axis and the driver support plane defining a driver plane center;

e) a nozzle cap support for supporting the nozzle cap, wherein the nozzle cap support has a central pivot point and a fixed support portion, the fixed support portion being substantially stationary relative to the driver plane center; and f) a drive module for moving the nozzle cap driver along the driver support plane, wherein i) changing a radial displacement of the nozzle cap driver relative to the driver plane center is operable to change an elevation angle of the average flow direction relative to the nozzle cap base plane, and ii) the average flow direction lies in a trajectory plane that is orthogonal to the nozzle cap base plane, the trajectory plane being definable by Cartesian coordinates originating at the central pivot point, the trajectory plane having a first dimension parallel to the nozzle cap base plane and a second dimension orthogonal to the nozzle cap base plane, the average flow direction being resolvable to be defined by a trajectory plane base component that is parallel to the first dimension and a trajectory plane elevation component that is parallel to the second dimension, wherein changing the angular orientation of the nozzle cap driver about the driver plane center is operable to change an angular orientation of the trajectory plane base component, the drive module being linked to the nozzle cap driver, and the driver support surface being within the drive module.

2. The articulated nozzle system as defined in claim 1 wherein:

the drive module comprises a first axis driver and a second axis driver;

the first axis driver is operable to move the nozzle cap driver in a direction parallel to a first axis along the driver support plane; and the second axis driver is operable to move the nozzle cap driver in a direction parallel to a second axis along the driver support plane; and the first axis differs from the second axis.

3. The articulated system according to claim 2 wherein the first axis driver comprises a first axis actuator assembly for moving the nozzle cap driver in the direction parallel to the first axis along the driver support plane, and the second axis driver comprises a second axis actuator assembly for moving the nozzle cap driver in a direction parallel to the second axis along the driver support plane.

4. The articulated nozzle system according to claim 3 wherein the first axis actuator assembly comprises at least one first axis pneumatic cylinder and the second axis actuator assembly comprises at least one second axis pneumatic cylinder.

5. The articulated nozzle system according to claim 3 wherein the first axis actuator assembly comprises a first pulley and belt assembly driven by a first motor, and the second axis actuator assembly comprises a second pulley and belt assembly driven by a second motor.

6. The articulated system according to claim 2 wherein the first axis is substantially orthogonal to the second axis.

7. The articulated nozzle system as defined in claim 2 wherein the first axis driver is operable to move the nozzle cap driver in the direction parallel to the first axis along the driver support plane by moving the second axis driver in the direction parallel to the first axis.

8. The articulated nozzle system as defined in claim 7 wherein the second axis driver comprises a second axis base, and the nozzle cap driver is slidably coupled to the second axis base to allow for movement of the nozzle cap driver along the driver support plane in a direction parallel to the second axis direction, relative to the second axis base.

9. The articulated nozzle system as defined in claim 8, wherein the first axis driver comprises a first axis base, the second axis base being slidably coupled to the first axis base to allow for movement of the second axis base in the direction parallel to the first axis.

10. The articulated nozzle system as defined in claim 9, wherein the first axis driver further comprises a first axis carriage, the first axis carriage being slidably coupled to the first axis base to allow for movement of the first axis carriage in the direction parallel to the first axis, and wherein the second axis base is coupled to the first axis carriage such that movement of the first axis carriage in the direction parallel to the first axis moves the second axis base in the direction parallel to the first axis.

11. The articulated nozzle system according to claim 1 wherein the nozzle cap support comprises a flexible boot for allowing for rotation of the nozzle cap about the central pivot point, wherein the fixed support portion comprises a distal portion of the flexible boot.

12. The articulated nozzle system according to claim 1 wherein the nozzle cap driver is mechanically coupled to the nozzle cap via a connector shaft for translating movement of the nozzle cap driver into movement of the nozzle cap, a first end of the connector shaft being coupled to the nozzle cap driver and a second end of the connector shaft being coupled to the nozzle cap, wherein changing the radial displacement and the angular orientation of the nozzle cap driver creates a corresponding change in the radial displacement and the angular orientation of the first end of the connector shaft such that changes in the radial displacement and the angular orientation of the first end of the connector shaft creates corresponding changes in the rotation of the nozzle cap about the central pivot point.

13. The articulated nozzle system according to claim 1 wherein the nozzle cap is linked to the nozzle cap driver via a drive magnet and a driven magnet, the drive magnet having a first magnetic field, the driven magnet having a second magnetic field, wherein the nozzle cap is coupled to the driven magnet, and the nozzle cap driver is coupled to the drive magnet such that changing the radial displacement and the angular orientation of the nozzle cap driver creates a corresponding change in a radial displacement and an angular orientation of the drive magnet.

14. The articulated nozzle system according to claim 13 wherein the first magnetic field is opposite in polarity to the second magnetic field to couple the driven magnet to the drive magnet, the driven magnet being movably mounted such that the driven magnet is movable to substantially follow the drive magnet to change the average flow direction from the nozzle cap base plane.

15. The articulated nozzle system according to claim 13 wherein the nozzle cap is coupled to the driven magnet via a connector shaft for translating movement of the driven magnet into movement of the nozzle cap, the connector shaft being rotatable about the central pivot point, and a first end of the connector shaft comprising the driven magnet and a second end of the connector shaft being coupled to the nozzle cap, and wherein changing the radial displacement and the angular orientation of the nozzle cap driver creates a corresponding change in a radial displacement and an angular orientation of the first end of the connector shaft.

16. The articulated nozzle system according to claim 1 wherein the nozzle cap support comprises a spherical bearing and a bearing housing for supporting the spherical bearing, the spherical bearing having i) an outer bearing that is fixedly attached to the bearing housing, ii) an inner bearing that rotates relative to the outer bearing, and iii) an inner void for allowing water to flow therethough, wherein the spherical bearing is coupled to the nozzle cap such that a rotation of the inner bearing relative to the outer bearing determines the average flow direction, and wherein the fixed support portion comprises the bearing housing and the outer bearing.

17. The articulated nozzle system according to claim 16 wherein the spherical bearing further comprises an intermediate bearing between the inner bearing and the outer bearing, the intermediate bearing being able to rotate relative to the outer bearing, and the inner bearing being able to rotate relative to the intermediate bearing, and wherein the spherical bearing is coupled to the nozzle cap such that a combined rotation of the intermediate and inner bearings determines the average flow direction.

18. The articulated nozzle system according to claim 16 further comprising:

an upper flexible boot enclosing the nozzle cap for protecting the nozzle cap and for allowing for movement of the nozzle cap about the central pivot point, and a lower flexible boot enclosing the bottom of the spherical bearing for protecting the spherical bearing and for allowing for rotation of the inner bearing about the central pivot point.

19. The articulated nozzle system according to claim 1 wherein the nozzle cap driver and drive module are isolated from the water flow path.

20. The articulated nozzle system according to claim 1 further comprising a fixed light source for illuminating the water exiting the nozzle cap.

21. The articulated nozzle system according to claim 1 wherein the elevation angle of the average flow direction is in the range of approximately 75 degrees to 90 degrees, measured from the nozzle cap base plane.

* * * * *